US006497984B2

(12) United States Patent
Itami et al.

(10) Patent No.: US 6,497,984 B2
(45) Date of Patent: Dec. 24, 2002

(54) IMAGE FORMING METHOD AND IMAGE FORMING APPARATUS

(75) Inventors: Akihiko Itami; Masao Asano; Hiroshi Yamazaki; Hiroyuki Yamada, all of Hachioji (JP)

(73) Assignee: Konica Corporation (JP)

( * ) Notice: Subject to any disclaimer, the term of this patent is extended or adjusted under 35 U.S.C. 154(b) by 2 days.

(21) Appl. No.: 09/829,376

(22) Filed: Apr. 9, 2001

(65) Prior Publication Data

US 2001/0051312 A1 Dec. 13, 2001

(30) Foreign Application Priority Data

Apr. 13, 2000 (JP) ..... 2000-111961

(51) Int. Cl.[7] ..... G03G 21/00
(52) U.S. Cl. ..... 430/125; 399/350
(58) Field of Search ..... 430/125, 110.4, 430/110.3, 66; 399/350

(56) References Cited

U.S. PATENT DOCUMENTS 6,197,464 B1 * 3/2001 Dinh et al. ..... 430/66
6,203,962 B1 * 3/2001 Itami et al. ..... 430/125

OTHER PUBLICATIONS

Publication No. 10–251277 and Abstract of Japan Sep. 22, 1998.

Publication No. 09–190004 and Abstract of Japan Jul. 22, 1997.

* cited by examiner

*Primary Examiner*—John Goodrow
(74) *Attorney, Agent, or Firm*—Beirman, Muserlian and Lucas

(57) ABSTRACT

An electrophotographic image forming method employing a photoreceptor is disclosed. The decrease ΔHd (in $\mu$m), in layer thickness per rotation in wear test of the organic electrophotographic photoreceptor defined in the specification, is in the range of $0 \leqq \Delta Hd < 1 \times 10^{-5}$, and a toner used in said development process is one which is obtained by suspension-polymerizing a polymerizable composition consisting of at least a polymerizable monomer and a colorant in a water based medium or one which is obtained by fusing resinous particles in a water based medium.

15 Claims, 3 Drawing Sheets

FIG. 1 ( a )
TONER HAVING NO CORNERS
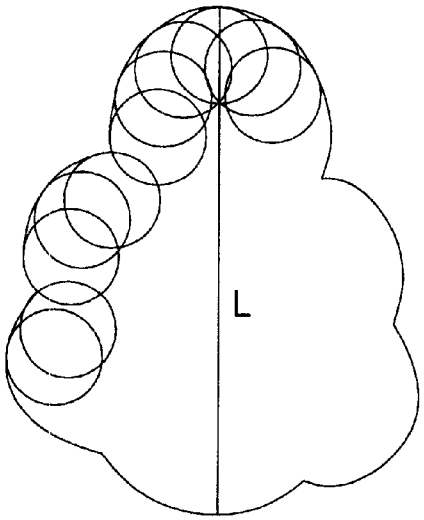
FIG. 1 ( b )
TONER HAVING CORNERS
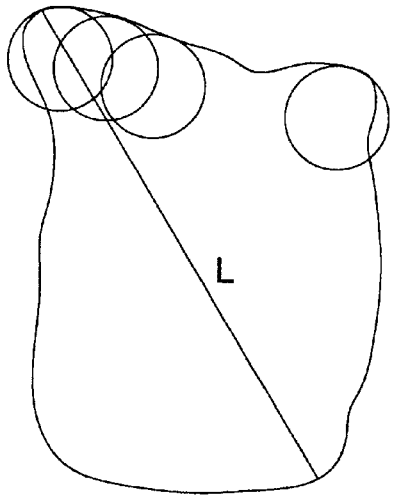
FIG. 1 ( c )
TONER HAVING CORNERS
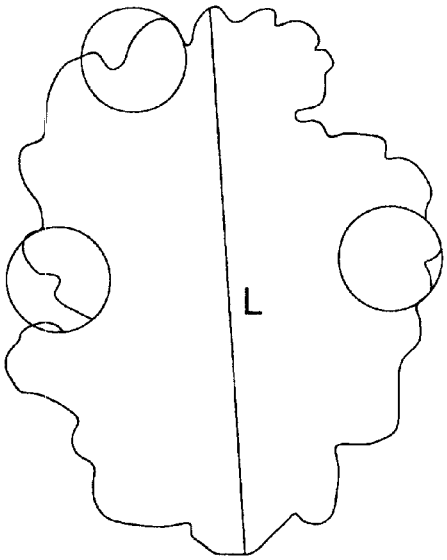

IMAGE FORMING METHOD AND IMAGE FORMING APPARATUS

FIELD OF THE INVENTION

The present invention relates to an image forming method and an image forming apparatus employed in electrophotographic copiers, printers, and the like.

BACKGROUND OF THE INVENTION

In recent years, widely employed as electrophotographic photoreceptors, have been organic photoreceptors. Compared to other photoreceptors, organic photoreceptors exhibit advantages in that it is easy to develop materials which correspond to various types of exposure light sources ranging from visible light to infrared rays; it is possible to select materials which result in minimal environmental pollution; their production cost is lower, and the like. However, said organic photoreceptors exhibit disadvantages in that the mechanical strength is insufficient, and when producing numerous prints, the photoreceptor surface tends to be degraded or abraded.

Since electrical and mechanical external force is directly applied to the surface of electrophotographic receptors (hereinafter referred occasionally to as photoreceptors) upon employing a charging unit, development unit, a transfer means, a cleaning unit, and the like, durability is required to counter such force.

Specifically required is durability to resist wear and abrasion of the photoreceptor surface due to friction, surface degradation due to active oxygen such as ozone, nitrogen oxides, and the like, which are generated during corona charging.

Heretofore, in order to enhance the durability of organic photoreceptors, it has been highly demanded to minimize wear due to scrubbing of cleaning blades and the like. As an approach to meet said demand, techniques in which a protective layer of high strength is provided on the surface of a photoreceptor are investigated. For example, Japanese Patent Publication Open to Public Inspection Nos. 9-190004 and 10-251277 describe the formation of hardened resins, employing organic silicon modified positive hole transportable compounds.

In addition, as a method to minimize a decrease in the layer thickness due to said mechanical wear, the inventors of the present invention proposed a charge transportable polysiloxane hardenable resin layer as the protective layer of the photoreceptor (Japanese Patent Application No. 11-70308). Photoreceptors having said charge transportable polysiloxane hardened resin layer as the protective layer exhibit excellent characteristics in terms of strength. The protective layer prepared by employing said siloxane resins exhibits high strength as well as excellent wear resistance. However, since said siloxane resins are relatively hydrophilic, various problems occur during repeated image forming processes.

According to the investigation performed by the inventors of the present invention, hydrolyzing groups as well as silanol groups, which have not undergone reaction, tend to remain on the surface of the film formed by crosslinked organic silicon based siloxane resins. Thus problems occur in which said film tends to be affected by the adsorption of water molecules, under an atmosphere of high humidity. When there are many groups which have not undergone reaction, under an atmosphere of high humidity, water molecules as well as discharge products, which are formed during discharging, tend to be adsorbed. As a result, the surface resisitivity decreases, and problems such as image smearing (occasionally called image blurring), and the like, occur.

Further, in the course of the investigation performed by the inventors of the present invention, it has been discovered that phenomena such as the formation of said image smearing, and the like, are adversely affected by types of toners employed for the image formation. Namely, when a toner which exhibits large adhesion force to a photoreceptor, for example, a toner having a wide size distribution, is employed, the toner on some of the surface parts of the photoreceptor is not removed and repeatedly passes through the cleaning section. As a result, filming occurs on the photoreceptor surface, while the toner is subjected to effects such as pressing pressure of said cleaning section. In said filming forming parts, image problems such as the image smearing, black spots, and the like, tend to occur. It has been discovered that even when only slight filming forms on the photoreceptor comprised of said siloxane resins, these image problems tend to occur. Further, the photoreceptor surface, on which said filming has once been formed, is subjected to non-uniform wear due to the cleaning member. As a result, problems occur in which cleaning properties degrade accumulatively due to said non-uniform wear.

SUMMARY OF THE INVENTION

An object of the present invention is to provide an image forming method and an image forming apparatus which result in high durability as well as high image quality, and more specifically to provide an image forming method and an image forming apparatus comprising an organic electrophotographic photoreceptor comprised of siloxane based resins, which result in high durability and consistently form excellent images under severe ambient conditions such as high temperature, high humidity, and the like.

The object of the present invention is accomplished employing any of the embodiments described below.

1. An electrophotographic image forming method including electrostatic charging on a photoreceptor, imagewise exposing on the photoreceptor to form a latent image, developing the latent image by a developer containing a toner, transferring the developed toner onto an image forming material, and cleaning residual toner on the photoreceptor, wherein decrease ΔHd (in $\mu$m), in layer thickness per rotation in wear test of the organic electrophotographic photoreceptor defined below, is in the range of $0 \leqq \Delta Hd < 1 \times 10^{-5}$, and a toner used in said development process is one which is obtained by suspension-polymerizing a polymerizable composition consisting of at least a polymerizable monomer and a colorant in a water based medium or one which is obtained by fusing resinous particles in a water based medium.

Wear Test

An electrophotographic photoreceptor connected to a driving section was brought into contact with a cleaning blade having a hardness of 70±1°, an impact resilience of 35±1 percent, a thickness of 2±0.2 mm, and a free length of 9±0.1 mm under conditions of a contact angle of 10±0.5 degrees in the counter direction and a thrust amount of 1.5±0.2 mm. While rotating said electrophotographic photoreceptor employing said driving section so that one rotation is completed within 0.1 to 10 seconds, toner particles having a volume average particle diameter of 8.5±0.5 $\mu$m, which was blended with powder having a number average particle diameter of 10 to 40 nm as the external additive, in an amount of 1±0.1 percent by weight with respect to said toner, was subjected to development so as to result in an adhered amount of 0.15±0.05 mg/cm$^2$. After development, said toner particles were removed. When said electrophotographic photoreceptor was subjected to at least 100,000 rotations, the layer thickness variation amount of said photoreceptor was measured and the value obtained by dividing the resultant amount by the number of rotations was designated as the layer thickness decreasing amount per rotation.

2. The image forming method of item 1 wherein the toner used in said development process is one which is obtained by suspension-polymerizing a polymerizable composition consisting of at least a polymerizable monomer and a colorant in a water based medium.

3. The image forming method of item 1 wherein the toner used in said development process is one which is obtained by fusing resinous particles in a water based medium.

4. The image forming method of item 1, wherein the organic electrophotographic photoreceptor comprises an overcoat layer comprising a siloxane based resin layer containing structural unit having charge transferability and a bridge structure.

5. The image forming method item 4, wherein said siloxane based resin layer is one which is formed by allowing an organic silicon compound having a hydroxyl group or a hydrolyzing group to react with the compound represented by the aforementioned General Formula (1).

$$B—(R_1—ZH)_m$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

6. The image forming method of item 5, wherein Z in the aforementioned General Formula (1) is a oxygen atom.

7. The image forming method of item 1, wherein the siloxane based resin layer contains an antioxidant.

8. The image forming method of item 7, wherein said antioxidant is a hindered phenol based antioxidant or a hindered amine based antioxidant.

9. The image forming method of item 4, wherein the siloxane based resin layer contains organic or inorganic fine particles.

10. The image forming method of item 4, wherein the siloxane based resin layer contains colloidal silica.

11. The image forming method of item 4, wherein a toner employed in said development process has a number average particle diameter of 3 to 8 $\mu$m.

12. The image forming method of item 4, wherein ratio of toner particles having no corners is at least 50 percent by number, and the number variation coefficient in the number particle size distribution is no more than 27 percent in the toner.

13. The image forming method of item 1, wherein ratio of said toner particles, in the range of a shape coefficient of from 1.0 to 1.6, is at least 65 percent by number of toner particles.

14. The image forming method described of item 1, wherein in a particle number based histogram showing a particle size distribution, in which, when the diameter of toner particles is represented by D (in $\mu$m), natural logarithm of D, i.e. lnD is taken as the abscissa and said abscissa is divided into a plurality of groups at an interval of 0.23, sum M of relative frequency $m_1$ of toner particles included in the most frequent group, and relative frequency $m_2$ of toner particles included in the second most frequent group, is at least 70 percent.

15. An image forming apparatus comprising an organic electrophotographic photoreceptor, a charging unit, an exposing unit, a development unit, a transfer unit, and cleaning unit, wherein decrease ΔHd (in $\mu$m), in layer thickness per rotation in said wear test of said organic electrophotographic photoreceptor, is in the range of $0 \leqq \Delta Hd < 1 \times 10^{-5}$, and a toner used in said development process is one which is obtained by suspension-polymerizing a polymerizable composition consisting of at least a polymerizable monomer and a colorant in a water based medium or one which is obtained by fusing resinous particles in a water based medium.

BRIEF DESCRIPTION OF THE DRAWINGS

FIG. 1 is a view explaining a "toner particle having no corner".

DETAILED DESCRIPTION OF HE INVENTION

Figure 2:
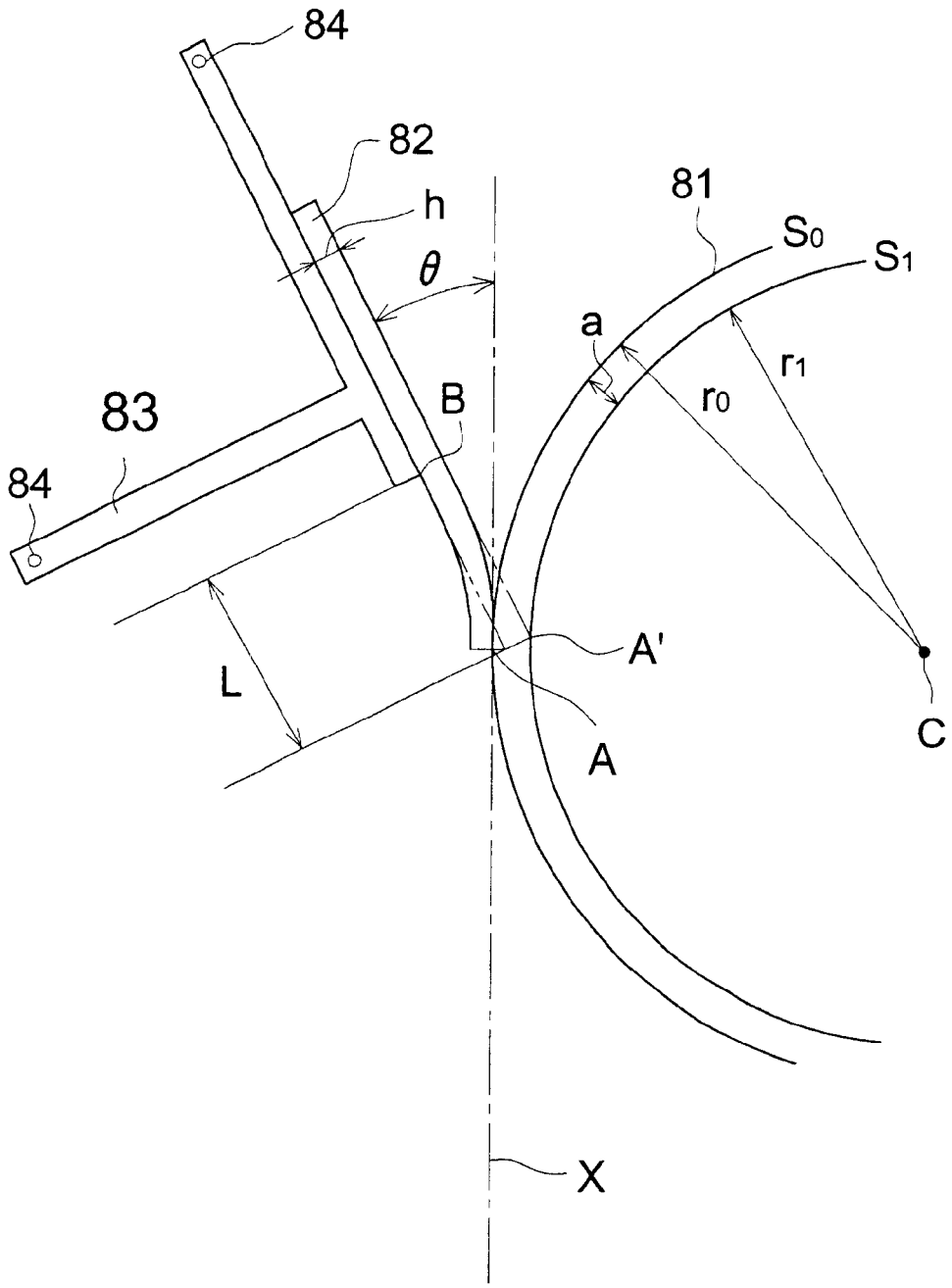
FIG. 2 is a view explaining contact conditions of a cleaning blade with a photoreceptor.

The present invention will now be detailed.

The inventors of the present invention analyzed problems when photoreceptors with minimized wear were employed, while considering adhesive properties to said photoreceptors. As a result, the present invention was achieved.

In the present invention, it was noted that image smearing, and streaking or spotting image problems, which formed while employing photoreceptors with minimized wear under an atmosphere of high temperature and high humidity, occurred due to the employed toners. Based on this realization, it has been possible to solve said problems.

The inventors of the present invention noted that adhesive properties of a toner to photoreceptors depended on its particle size distribution, as well as the width of its shape distribution. As a result, the present invention has been realized.

So-called pulverization toners, which have conventionally been prepared by melt kneading resins, colorants, and the like, and pulverizing the resulting mixture, result in non-uniform shapes due to minute unevenness of the broken surface formed by said pulverization. As a result, a number of toner particles, which exhibit great adhesive force to the photoreceptor surface, are included. Such toner particles tends to result in insufficient cleaning, in further toner filming, as well as image smearing.

On the other hand, toners, which are prepared by utilizing a so-called suspension-polymerization method, tend to result in a relatively spherical shape. As a result, the resulting particle size distribution as well as shape distribution narrows. Due to that, the adhesive force of toner particles prepared by utilizing said suspension-polymerization method becomes uniform, whereby cleaning properties are stabilized.

Further, toners prepared by fusing resinous particles have no active sites on the surface which are formed by pulverization but have a smooth surface so that the shape distribution as well as the particle diameter distribution of said toners narrows. As a result, said toners exhibit excellent cleaning properties. Accordingly, even when photoreceptors with high wear resistance are employed, it is possible to minimize the formation of image smearing and to form uniform images for an extended period of time.

Process of Preparation of Salt-out or Fused Toner

The preparation process of salt-out or fused toner includes a step of polymerization which prepare resin particles which may contain colorant by emulsion polymerization, a step of fusing the resin particles with colorant particles or resin particles containing colorant employing the above mentioned resin particles dispersion in a aqueous medium, a step of washing wherein the obtained particles are filtrated from the aqueous medium and surfactant etc. are removed therefrom, a step of dying the obtained particles, and further a step of adding additives from outside of the particles. Resin particles containing no colorant can be employed for the resin particles. In this instance the resin particles can be colored by fusing with colorant particles in aqueous medium after that colorant particle dispersion liquid is added to the dispersion liquid of the resin particles.

As for the fusing method it is preferable to salt-out and fuse by employing resin particles formed by polymerization process in particular. In case that resin particles containing no colorant are employed, the resin particles and the colorant particles.

Further, it is possible to fuse fine particles of internal additives such as releasing agents, charge control agents, and the like, along with fine resin particles and fine colorant particles.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Dispersion machines are not particularly limited, and listed are ultrasonic homogenizers, mechanical homogenizers, Manton-Gaulin and pressure type homogenizers, and medium type homogenizers such as sand grinders, Getman mill, diamond fine mills and the like.

Surfactants mentioned above are also employed in the dispersion process.

The salting-out/fusion process is accomplished as follows. Salting-out agents, comprised of alkaline metal salts or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

In the salting-out/fusion process, it is preferable that hold-over time after the addition of salting-out agents is as short as possible. Namely it is preferable that after the addition of salting-out agents, a dispersion comprised of resinous particles and colorant particles is heated as soon as possible and heated to a temperature higher than the glass transition point of said resinous particles.

The reason for this is that problems occur in which the aggregation state of particles varies depending on the hold-over time after salting out so that the particle diameter distribution becomes unstable and surface properties of fused toner particles fluctuate. The temperature during addition is allowed if it is not more than glass transition temperature of the resin and, 5 to 55° C. in general and 10 to 45° C. preferably.

Further, in the present invention, it is preferable to employ a method in which a salting-out agent is added at no higher than the glass transition temperature of fine resin particles, and thereafter, the resultant mixture is heated as soon as possible so that it is heated to at least the glass transition temperature of the same or higher. The time until to said temperature is preferably less than one hour. In addition, it is necessary to rapidly raise said temperature. The rate of temperature rise is preferably 0.25° C./minute. The upper limit is not specifically stated. However, when the temperature is abruptly raised, salting-out proceeds too quickly and problems occur in which it is difficult to control the particle diameter. Thus, said rate is preferably 5° C./minute or less.

Toner Preparation Process

Toner may be prepared by employing the toner particles obtained by above process, without giving further process, or adding the additives mentioned above for the purpose of, for example, improving fluidity, charging characteristics and cleaning characteristics.

Listed as devices employed to add said additives may be various mixers such as a tubular mixer, a Henschel mixer, a Nauter mixer, a V-shaped mixer, and the like, which are known in the art.

The toner may contain such component as releasing agent and charge control agent inside of the particle. Specifically, examples of the releasing agent includes low molecular weight polypropylene, low molecular weight polyethylene, natural waxes such as carnauba wax, amide wax and the like.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

Particles of these releasing agents and charge control agents preferably have a number average particle diameter of 10 to 500 nm in the dispersed state. Shape Coefficient of the Toner The shape coefficient of the toner of the invention is an index of roundness of the toner particles and is defined by the formula.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In order to obtain this shape coefficient, toner particles are magnified 2000 times employing a scanning type electron microscope and their image is photographed. Subsequently, employing the resulting electron microscopic image, the photographic image is analyzed, using "SCANNING IMAGE ANALYSER" (manufactured by Nippon Denshi Co.). At the time, a figure, which is statistically meaningful, for example 100 colored particles, is employed. The shape coefficient is calculated by the formula described above.

The ratio of toner particles having a shape coefficient of 1.0 to 1.6 is at least 70 percent by number. And further, the ratio of toner particles having a shape coefficient of 1.2 to 1.6 is at least 65 percent, more preferably 70 percent or more by number.

Effect of the Toner Shape Coefficient

Toner having uniform shape coefficient is employed in the image forming method of the invention the charging characteristics of each toner article becomes uniform, and a good image free from fog can be obtained.

When the content of toner having shape coefficient of 1.0 to 1.6 is 65 number % or more, generation of fine toner particles is inhibited since the toner particles are hard to be cracked, and therefore, the filming due to cleaning incompleteness is prevented.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

Of the preparation methods, the polymerized toner method is preferable since it is simple as well as convenient as a toner production method, the surface uniformity is excellent compared to pulverized toner, and the like. Variation Coefficient of the Toner The variation coefficient of the toner is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

Number Variation Coefficient of the Toner

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/Dn)\times 100 \text{ (in percent)}$$

wherein S represents the standard deviation in the number particle size distribution and $D_n$ represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

Content of the Toner Having No Corner

Population of the toner particles having substantially no corner is 50 number % or more, and is preferably 70% or more in the toner particles in the toner particles of Toner <B>.

Population of the toner particles having substantially no corner is 50 number % or more, and is preferably 70% or more in the toner particles in the toner particles of Toner <A> and Toner <B>.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

The toner particles having substantially no corners mean those having no projection to which charges are concentrated or which tend to be worn down by stress. Namely, as shown in FIG. 1(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 1(*b*) and 1(*c*) show the projection images of a toner particle having corners.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of said corners is determined. Said measurement is carried out for 100 toner particles.

Particle Diameter of the Toner

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Of methods to control the shape coefficient, the polymerized toner method is preferable since it is simple as well as convenient as a toner production method, the surface uniformity is excellent compared to pulverized toner, and the like.

When toner is prepared employing a suspension polymerization method, conventionally, the polymerization is carried out in a laminar flow, resulting in toner particles having a nearly spherical shape. For example, in the toner described in Japanese Patent Publication Open to Public Inspection No. 56-130762, the ratio of toner particles having a shape coefficient of 1.2 to 1.6 is approximately 20 percent by number, and the variation coefficient of the shape coefficient is approximately 18 percent, while the ratio of toner particle have no corners is approximately 85 percent by number. Furthermore, as previously described in the method which controls a number variation coefficient in the number particle size distribution, large oil droplets comprised of polymerizable monomers are subjected to repeated mechanical shearing to reduce the size of the droplets to nearly a similar size as the desired toner particles. Therefore, the distribution of oil droplet diameter is broadened. As a result, the particle size distribution of the resulting toner widens. Therefore, in order to decrease the number variation coefficient, a classification operation is required.

When toner is prepared employing the polymerization method in which resin particles are associated or fused, for example, toner described in Japanese Patent Publication Open to Public Inspection No. 63-186253 comprises approximately 60 percent by number of toner particles having a shape coefficient of 1.2 to 1.6, its variation coefficient of the shape coefficient is approximately 18 percent and further, its ratio of toner particles having no corners is approximately 44 percent by number. Still further, the particle size distribution of said toner is wide and the number variation coefficient is 30 percent. Accordingly, in order to decrease the number variation coefficient, a classification operation is required.

Herein, the toner particle diameter of the present invention is from about 3 to about 8 $\mu$m in terms of the number average particle diameter. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like. Herein values are shown which are obtained based on the particle diameter distribution in the range of from about 2.0 to about 40 $\mu$m, employing an aperture having an aperture diameter of 100 $\mu$m of said Coulter Counter TA-II as well as said Coulter Multisizer.

The toner contains toner particles having particle size of not more than 3.0 $\mu$m in an amount of 30 number % or less. The preparation method to obtain the toner having such characteristics is not specially restricted. In the pulverization method excess pulverization is inhibited, and/or classification is repeated. In the polymerization method, suspension polymerization or fusing method is also preferable.

In the polymerization method, fine particles can be removed by centrifugal separation in the resin particles dispersion.

Developers

The toner of the present invention may be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 $\mu$m are incorporated into toner particles and employed as a magnetic single component developer. As the incorporation method, magnetic particles are incorporated into non-spherical particles in the same manner as for colorants.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

Organic Photoreceptor

The photoreceptor employed in the invention will be described.

The organic photoreceptor according to the invention contains an organic compound having at least one of charge generating function and charge transfer function which are necessary to compose the electro-photoreceptor, and examples thereof include any photoreceptor such as photoreceptor composed of a conventional organic charge generating material or a conventional organic charge transfer material and a photoreceptor composed of polymer complex having charge generating function and charge transfer function.

A photoreceptor can minimize its deterioration of surface property and consequently the deterioration of obtained image can be minimized by employing a resin having high resistance against abrasion in the top layer of the photoreceptor in the image formation method of the invention. The layer thickness decrease amount per rotation $\Delta Hd$ (in $\mu$m) of the organic photoreceptor is represented by $0 \leqq \Delta Hd < 5\times10^{-5}$.

In the present invention, the layer thickness decrease amount per rotation $\Delta Hd$ (in $\mu$m) is the value obtained by carrying out the wear test described below.

The layer thickness decrease amount per rotation $\Delta Hd$ (in $\mu$m) is $0 \leqq \Delta Hd < 5\times10^{-5}$ and preferably $0 \leqq \Delta Hd < 5\times10^{-6}$, more preferably $0 \leqq \Delta Hd < 3\times10^{-6}$.

FIG. 2 is a view explaining the contact conditions of a cleaning blade with the photoreceptor in said wear test.

In FIG. 2, reference numeral 81 is a photoreceptor and $\theta$ is the contact angle. Further, as shown in FIG. 2, free length L of said cleaning blade 82 represents the length from the end B of support member 83 to the end point of said blade prior to its deformation.

Reference numeral 84 is a screw to secure support member 33, while "h" is the thickness of said blade.

Further, contact angle $\theta$ is the angle between the tangential line at contact point A of said photoreceptor and the blade prior its deformation (in FIG. 2, shown as a dotted line).

Further, as shown in FIG. 2, thrust amount "a" is the difference between radius $r_0$ of the external circumference of a photoreceptor and radius $r_1$ of circle $S_1$, having, as the center, central axis C of said photoreceptor which is located at position A' of the blade prior to its deformation (in FIG. 2, shown as a dotted line).

The physical property parameters, hardness and impact resilience of the rubber blade, comprised of elastic materials which are employed for said cleaning blade, are measured employing JIS A Hardness and Physical Test Method of Vulcanized Rubber JIS K6301, respectively.

Further, the adhesion amount of toner as described herein means the weight of the tone per $cm^2$, which is developed on the photoreceptor surface, by bias development employing a development unit. In the wear test of the present invention, it corresponds to the toner amount per $cm^2$ which is removed by the cleaning blade.

The adhesion amount of toner is obtained as follows. Toner, which is adhered onto the photoreceptor surface through development, is transferred onto an adhesive tape and the weight difference of said tape is obtained before and after the transfer of the toner, and the resultant difference is converted to a per $cm^2$ volume.

Example of Wear Test

The specific example of the layer thickness decrease amount measurement of the present invention is described below. A Konica 7040 digital copier, manufactured by Konica Corp., was modified, and a wear tester, which only comprised a development section and a cleaning section, was prepared. Said cleaning section was brought into contact with a cleaning blade having a hardness of 70°, an impact resilience of 35 percent, a thickness of 2 mm, and a free length of 9 mm, under conditions of a contact angle of 10 degrees in the counter direction and a thrust amount of 1.5 mm. Subsequently, while rotating a 60 mm diameter cylindrical electrophotographic photoreceptor at a linear speed of 210 mm/second, development was carried out so as to realize an adhered toner amount of 0.1 to 0.2 $mg/cm^2$, utilizing the potential difference between the bias potential of the development section and a photoreceptor which was grounded. Developer prepared by a method mentioned below was employed for the test. Under said conditions, said electrophotographic photoreceptor was rotated at least 100,000 times at an ambience of normal temperature and normal humidity (20° C. and 50 percent RH), and the development-cleaning process was repeatedly carried out. Then the layer variation amount (difference form the initial layer thickness) of said photoreceptor was measured. The measured value was divided by the number of rotations of said photoreceptor, and the resultant value was designated as the layer thickness decrease value per rotation.

Preparation of Developer for Evaluation

After melt-kneading 100 parts of styrene acrylic resin having a ratio by weight of styrene:butyl acrylate:butyl methacrylate=75:20:5, 10 parts of carbon black, and 4 parts of low molecular weight of polypropylene (having a number average molecular weight of 3,500), the resulting mixture was finely pulverized employing a mechanical pulverizer and classified, whereby colored particles having a volume average particle diameter of 8.5 $\mu$m were obtained.

Subsequently, 0.4 part of hydrophobic silica having an average particle diameter of 12 nm and 0.6 part of titanium particles having an average particle diameter of 30 nm as the external additives were mixed with 100 parts of the obtained colored particles, and the resulting mixture was mixed at room temperature for 10 minutes, employing a Henschel mixer operated at a circumferential speed of the stirring blade of 40 m/second. Thus, a negatively chargeable toner was obtained. The bulk density of said toner was 0.41 $g/cm^2$.

A developer, having a toner concentration of 5 percent, was prepared by mixing said toner with a silicone resin-coated ferrite carrier having a volume average particle diameter of 60 $\mu$m.

Measurement of Bulk (Apparent) Density

Apparent density was determined employing Powder Tester (produced by Hosokawa Micron).

Said measurement is carried out as follows. On a vibrating table, a 60-mesh sieve is placed and just under said sieve, a cup (having an interior volume of 100 ml) for measuring apparent density, the weight of which has been determined, is placed. Subsequently, the scale of a rheostat is adjusted to 2.0 and vibration is initiated. A measured sample is allowed to flow from the upper section of the vibrating 60-mesh sieve so as to enter into said cup for measurement.

When the sample cap is heaping full, vibration is terminated. Subsequently, the upper surface of the heaped cup is leveled employing a scale, and the cup is accurately weighed employing a balance.

The cup for measurement has an interior volume of 100 ml, and the apparent density in $g/cm^3$=the weight of the sample÷100.

The sample is employed after leaving it under an ambience of 20° C. and relative humidity 50 percent for about 12 hours, and the measurement is carried out under an atmosphere of 20° C. and 50 percent relative humidity.

Measurement Method of Layer Thickness

The thickness of the uniformly thick section of a photosensitive layer is determined at 10 positions, and the average is designated as the thickness of said photosensitive layer. Employed as a thickness measurement apparatus was an eddy-current method thickness measurement apparatus, Eddy 560C (produced by Helmut Fischer GMBTE Co.).

The organic photoreceptors employed in the present invention will now be described.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm. When said circularity as well said deviation exceeds said limits, it becomes difficult to form consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωm or more. Alumite substrate or heat sealed alumite is also applied.

The cylindrical electrically conductive support having thereon at least two resin layers, as described in the present invention, means a cylindrical electrically conductive support having thereon at least two layers in which resins exhibit major function for the layer formation, and said resin layer is comprised of at least two of a sublayer, a photosensitive layer, as well as, in addition, a charge generating layer, a charge transport layer, and the like.

The preferable layer configuration of the electrophotographic photoreceptor of the present invention will now be described.

Sublayer

In order to improve adhesion between the electrically conductive support and said photosensitive layer or to minimize charge injection from said support, provided is the sublayer or u-coat layer (UCL) employed on the photoreceptor of the present invention between said support and said photosensitive layer. Listed as materials of said sublayer are polyamide resins, vinyl chloride resins, vinyl acetate resins, and copolymer resins comprising at least two repeating units of these resins. Of these subbing resins, polyamide resins are preferable as the resins which are capable after repeated use of minimizing an increase in residual potential. Further, the thickness of the interlayer comprised of these resins is preferably between 0.01 and 0.5 μm.

Listed as the sublayer, which is most preferably employed, is those comprised of hardenable metal resin which is subjected to thermal hardening employing organic metal compound such as silane coupling agent, titanium coupling agent, and the like. The thickness of the interlayer comprised of said hardenable metal resins is preferably between 0.1 and 2 μm.

Photosensitive Layer

The photosensitive layer configuration of the photoreceptor of the present invention may be one comprising a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transport layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu-Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As other materials, if desired, incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV, from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. The ratio of binder resins to charge transport materials is preferably between 10 and 200 weight parts per 100 weight parts of the binder resins. Further, the thickness of the charge transport layer is preferably between 10 and 40 μm.

Surface Layer (Surface Layer Comprising Siloxane Based Resin Possessing Charge Transportability)

Preferred as electrophotographic photoreceptors of the present invention, which exhibit high hardness, as well as minimize the increase in residual potential, are those in which a resin layer comprising siloxane based resins, having structural units exhibiting charge transportability, is used as the surface layer. Said siloxane based resin layer is formed by applying, onto a support, a coating composition prepared by employing organic silicon compounds represented by General Formula (2), described below, as the raw materials and subsequently drying said coated layer. These raw materials undergo hydrolysis in a hydrophilic solvent and subsequently result in a condensation reaction. Thus, they form condensation products (oligomers) of organic silicon compounds in a solvent. By applying these coating compositions onto a support and subsequently drying the resultant coated layer, it is possible to form a resin layer comprising siloxane based resins forming a three-dimensional net structure.

$$(R)_n—Si—(X)_{4-n}$$ General Formula (2)

wherein R represents an organic group in which a carbon atom directly bonds to a silicon atom, X represents a hydroxyl group or a hydrolyzable group, and n represent an integer of 0 to 3.

In organic silicon compounds represented by General Formula (2), listed as organic groups represented by R, in which the carbon atom directly bonds to the silicon atom, are an alkyl group such as methyl, ethyl, propyl, butyl, and the like; an aryl group such as phenyl, tolyl, naphthyl, biphenyl, and the like; an epoxy containing group such as γ-glycidoxypropyl, β-(3,4-epoxycyclohexyl)ethyl, and the like; an acryloyl or methacryloyl containing group such as γ-acryloxypropyl, and γ-methacryloxypropyl; a hydroxy containing group such as γ-hydroxypropyl, 2,3-dihydroxypropyloxypropyl, and the like; a vinyl containing group such as vinyl, propenyl, and the like; a mercapto containing group such as γ-mercaptopropyl, and the like; an amino containing group such as γ-aminopropyl, N-β (aminoethyl)-γ-aminopropyl and the like; a halogen containing group such as γ-chloropropyl, 1,1,1-trifluoropropyl, nonafluorohexyl, perfluorooctylethyl and the like; and others such as a nitro- or cyano-substituted alkyl group. Specifically preferred are alkyl groups such as methyl, ethyl, propyl, butyl, and the like. Further, listed as hydrolizable groups represented by X are an alkoxy group such as methoxy, ethoxy, and the like, a halogen atom, and an acyloxy group. Specifically preferred are alkoxy groups having not more than 6 carbon atoms.

Further, organic silicon compounds represented by General Formula (2) may be employed individually or in combinations of two or more types. However, it is preferable to employ at least one type of organic silicon compounds represented by General Formula (2), in which n is 0 or 1.

Further, in the specific organic silicon compounds represented by General Formula (2), when n is at least 2, a plurality of R may be the same or different. In the same manner, when n is not more than 2, a plurality of X may be the same or different. Still further, when at least two types of organic silicon compounds represented by General Formula (2) are employed, R and X, in each compound, may be the same or different.

Said resin layer is preferably formed so that colloidal silica is incorporated into the composition comprising said organic silicon compounds or hydrolyzed condensation products thereof. The colloidal silica, as described herein, means silicon dioxide particles which are dispersed colloidally into a dispersion medium. Said colloidal silica may be added during any stage of preparation of the coating composition. Said colloidal silica may be added in the form of water based or alcohol based sol, and aerosol prepared in a gas phase may be dispersed directly into the coating composition.

In addition, metal oxides such as titania, alumina, and the like, may be added in the form of sol or a particle dispersion.

Colloidal silica and said tetrafunctional (n=0) or trifunctional (n=1) organic silicon compounds provide elasticity as well as rigidity with the resin layer of the present invention through the formation of a bridge structure. As the ratio of bifunctional silicon compounds (n=2) increases, rubber elasticity as well as hydrophobicity increases. Unifunctional silicon compounds (n=3) undergo no polymerization but increase hydrophobicity upon reacting with residual SiOH groups which have not undergone reaction.

In order to prepare the surface layer of the present invention, which is required to exhibit high hardness as well as high elasticity, at least one type of said tetrafunctional (n=0) or trifunctional (n=1) organic silicon compounds is preferably employed as the raw material so as to from a siloxane based resin layer provided with the desired elasticity as well as the desired rigidity.

It is possible to minimize an increase in the residual potential of said resin layer, which is comprised of siloxane based resins having structural units having charge transportability which are prepared utilizing condensation reaction of said organic silicon compounds or condensation products thereof with the compounds represented by General Formula (1) described below.

$$B—(R_1—ZH)_m \qquad \text{General Formula (1)}$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

Further, compounds represented by the aforementioned General Formula (1) may be subjected to condensation reaction with the hydroxyl group on the colloidal silica surface and incorporated into said siloxane based resin layer.

In the present invention, employed may be a composite siloxane based resin layer prepared by adding other metal hydroxides (for example, hydrolyzed products of each alkoxide of aluminum, titanium, and zirconium) except for said colloidal silica.

B of General Formula (1) is a univalent group comprising a charge transportable compound structure. Comprising a charge transportable compound structure, as described herein, means that the compound structure obtained by excluding a $R_1$—ZH group in General Formula (1) possesses charge transportability or a compound represented by BH, which is obtained by substituting $R_1$—ZH in the aforementioned General Formula (1) with a hydrogen atom, possesses charge transportability.

In other definition, the charge transportable structural unit is a chemical structural unit or a residue of charge transportable compound by which an electric current caused by charge transportation can be detected by a known method for detecting the charge transportation ability such as Time-Of-Flight method.

The composition ratio of the total weight (H) of the condensation product formed from said organic silicon compound, having a hydroxyl group or hydrolyzable group, and an organic silicon compound, having a hydroxyl group or a hydrolyzable group, to the composition of compound (I) represented by the aforementioned General Formula (1) is preferably between 100:3 and 50:100 in terms of the weight ratio, and is more preferably between 100:10 and 50:100.

In the present invention, further, colloidal silica or other metal oxides may be added. When colloidal silica or other metal oxides (J) are added, 1 to 30 weight parts of (J) is preferably employed with respect to 100 parts of said total weight (H) plus the weight of compound (I) component.

When a component, having said total weight (H), is employed within said range, the surface layer of the photoreceptor of the present invention exhibits high hardness as well as sufficient elasticity.

When said siloxane based resin layer is formed, in order to enhance condensation reaction, condensation catalysts are preferably employed. The condensation catalysts employed herein may be those which either catalytically act on condensation reaction or move the reaction equilibrium of the condensation reaction in the reaction proceeding direction.

Employed as specific condensation catalysts may be those known in the art such as acids, metal oxides, metal salts, alkyl aminosilane compounds, and the like, which have conventionally been employed in silicone hard coat materials. For example, listed may be alkali metal salts of organic carboxylic acids, nitrous acid, sulfurous acid, aluminic acid, carbonic acid, and thiocyanic acid; organic amine salts (tetramethylammonium hydroxide, tetramethylammonium acetate), tin organic acid salts (stannous octoate, dibutyl tin acetate, dibutyl tin dilaurate, dibutyl tin mercaptide, dibutyl tin thiocarboxylate, dibutyl tin maliate, and the like; and the like.

In General Formula (1), the group having the charge transportable compound structure represented by B, has two types, that is, a positive hole transport type and an electron transport type. Listed as positive hole transport type groups are groups having structural units such as oxazole, oxadiazole, thiazole, triazole, imidazole, imidazolone, imidazolone, bisimidazoline, styryl, hydrazone, benzidine, pyrazoline, triarylamine, oxazolone, benzothiazole, benzimidazole, quinazoline, benzofuran, acridine, phenazine, and the like, and groups derived from derivatives thereof. On the other hand, listed as electron transport type groups having structural units such as succinic anhydride, maleic anhydride, phthalic anhydride, pyromellitic anhydride, mellitic anhydride, tetracyanoethylene, tetracyanooxodimethane, nitrobenzene, dinitrobenzene, trinitrobenzene, tetranitrobenzene, nitrobenzonitrile, picryl chloride, quinonechloroimide, chrolanyl, bromanyl, benzoquinone, napthoquinone, diphenoquinone, tropoquinone, anthraquinone, 1-chloroanthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorenone, 2,4,7-trinitrofluorenone, 2,4,5,7-tetranitrofluorenone, 9-fluoronylidenedicyanomethylenemalonitrile, polynitro-9-fluoronylidenedicyanomethylenemalonitrile, picric acid, o-nitro-benzoic acid, 2,5-dinitrobenzoic acid, perfluorobenzoic acid, 5-nitrosalicylic acid, 3,5-dinitrosalycilic acid, phthalic acid, mellitic acid, and groups derived from derivatives thereof.

Representative examples of compounds represented by General Formula (1) are described below.

Examples of compounds, in which Z represents an oxygen atom in General Formula (1), are listed below.

(B-1)

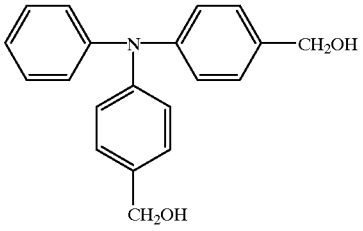

-continued (B-2)

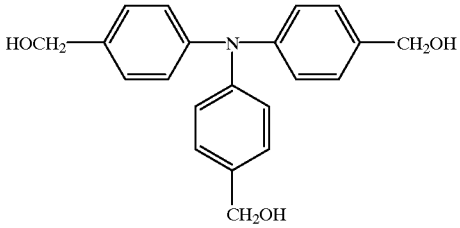

(B-3)

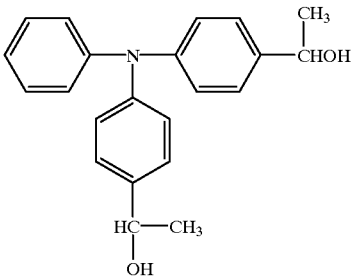

(B-4)

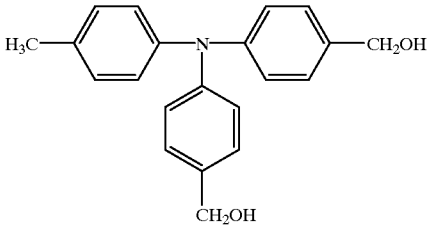

(B-5)

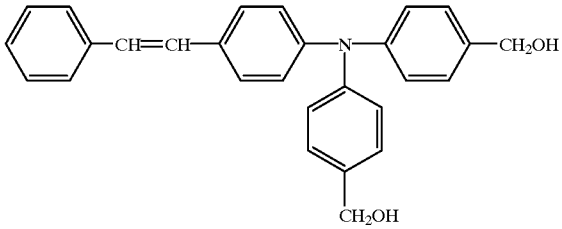

(B-6)

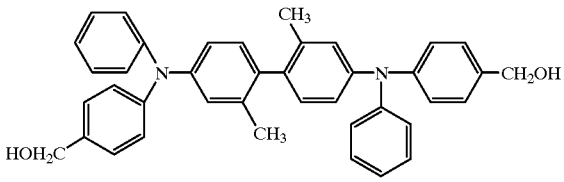

(B-7)

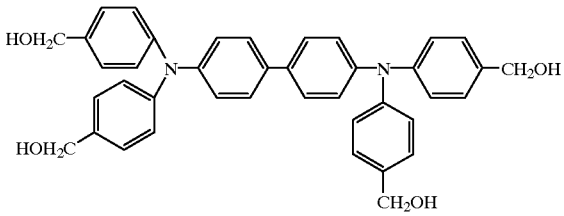

-continued
(B-8)
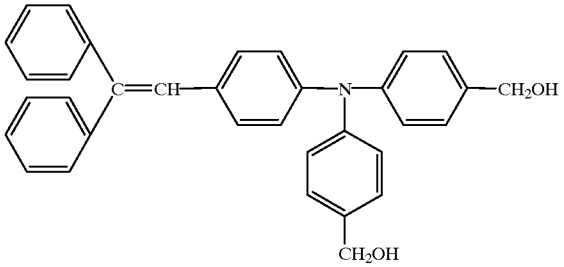
(B-9)
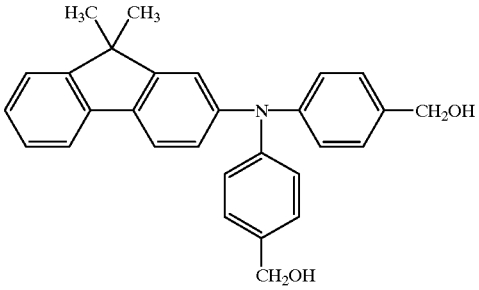
(B-10)
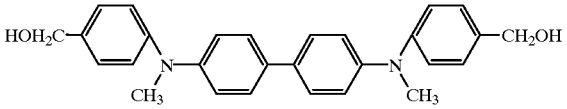
(B-11)
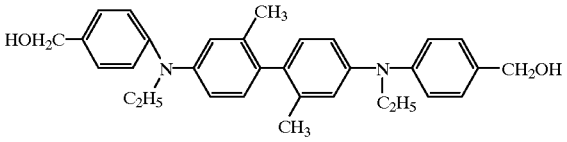
(B-12)
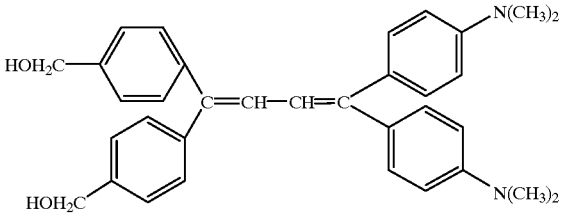
(B-13)
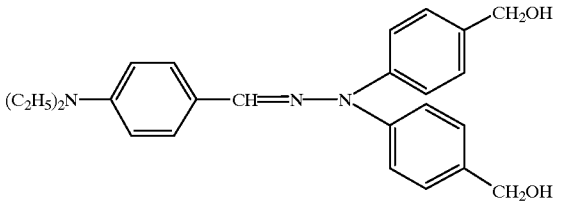
-continued
(B-14)
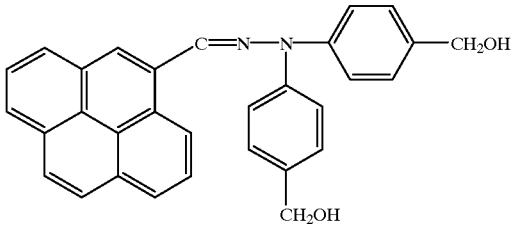
B-15
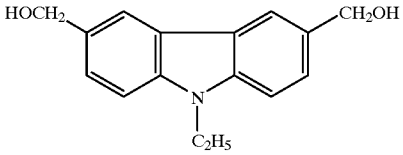
B-16
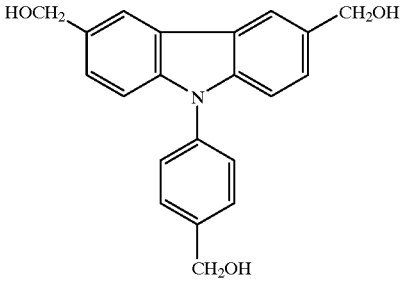
B-17
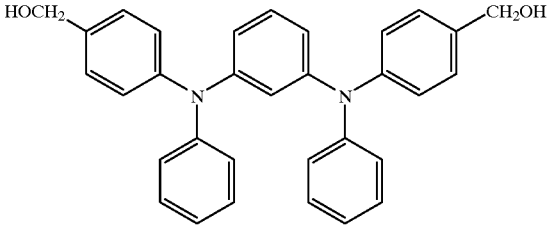
B-18
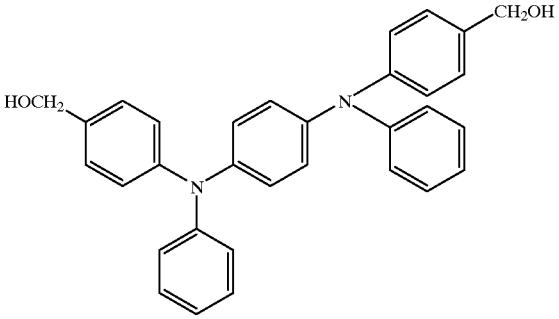
B-19
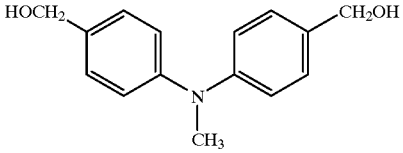

-continued
B-20
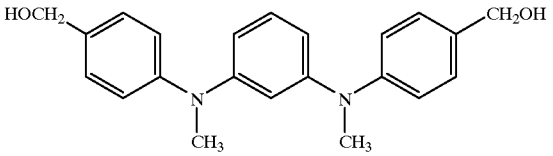
B-21
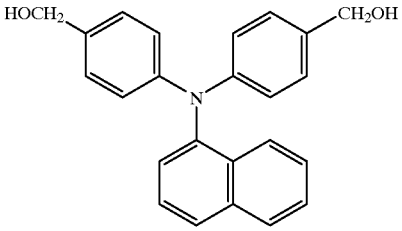
(B-22)
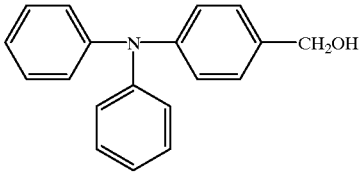
(B-23)
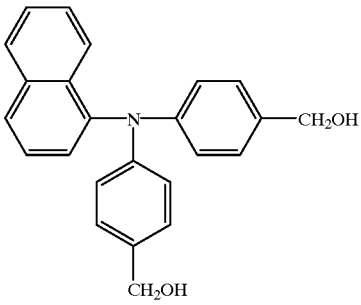
(B-24)
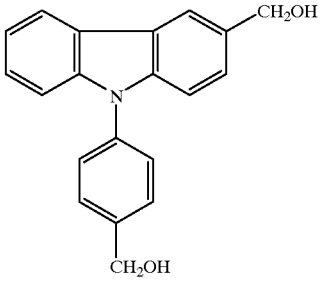
(B-25)
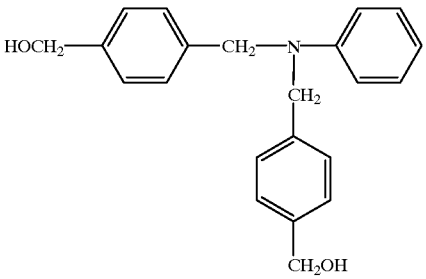
-continued
(B-26)
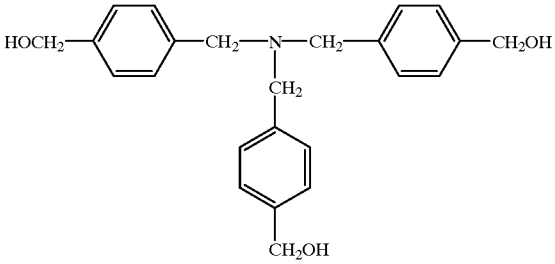
Next, examples of compounds, in which Z represents an NH group in General Formula (1), are listed below.
W-1
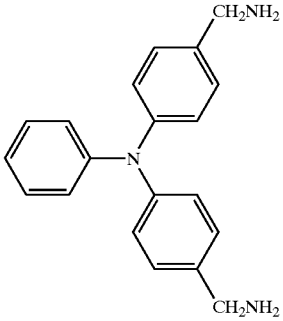
W-2
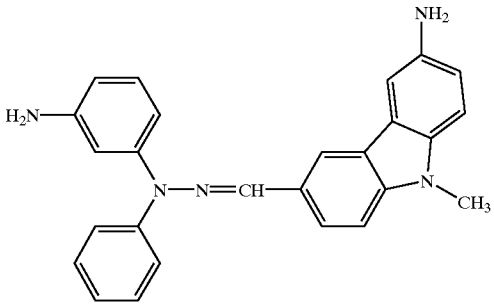
W-3
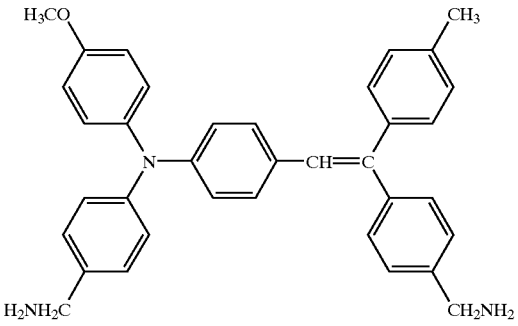

-continued

W-4

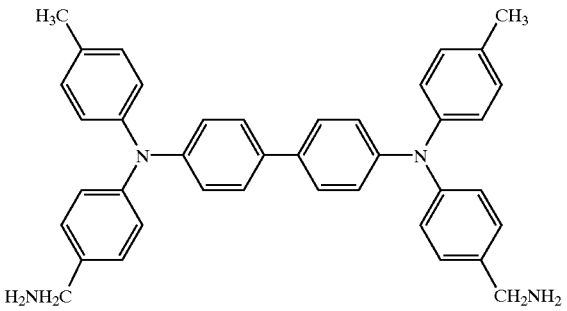

W-5

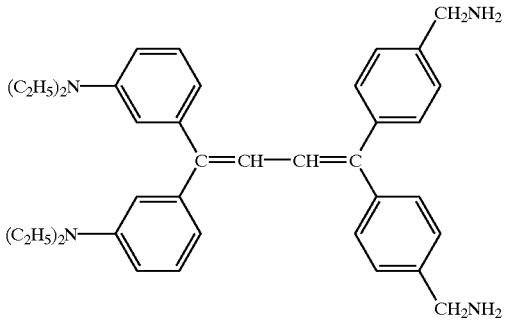

W-6

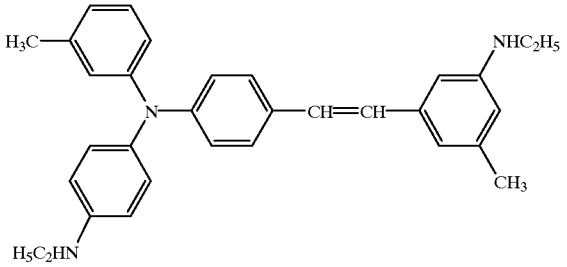

Next, examples of compounds, in which Z represents a mercapto group (SH) in General Formula (1), are listed below.

V-1

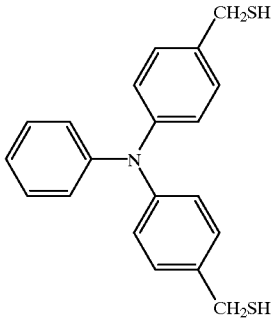

-continued

V-2

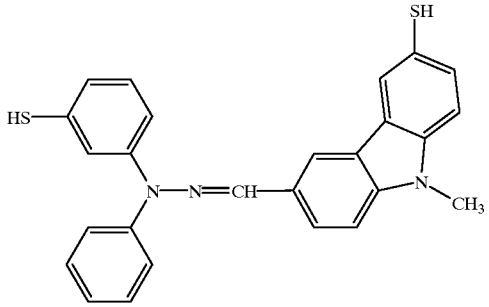

V-3

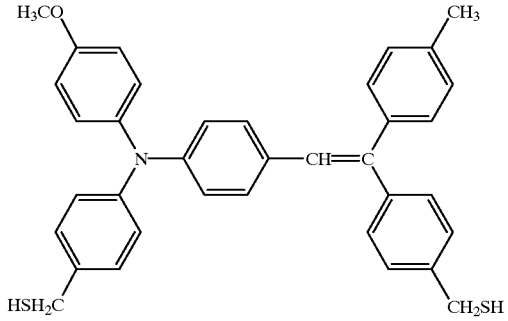

V-4

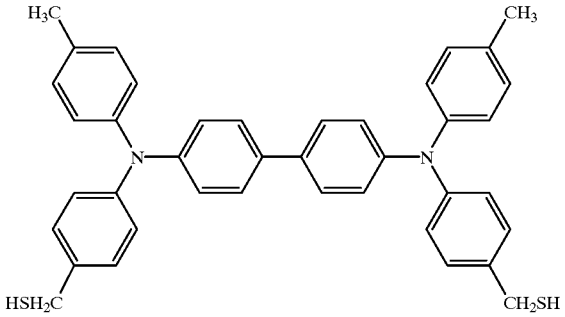

V-5

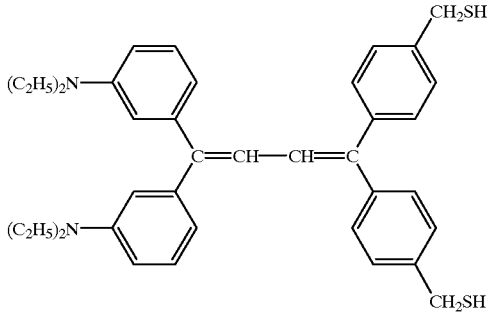

The most preferable compounds, among those represented by General Formula (1) described below, are compounds in which Z represents a hydroxyl group (OH), and m is at least 2. Said compounds, in which Z represents a hydroxyl group (OH) and m is at least 2, react with said organic silicon compounds. As a result, said compounds enter into the net structure of the siloxane based resin so that a resin layer can be formed which exhibits high hardness as well as minimizes the increase in the residual potential.

A charge transferable compound containing a group containing silicone atom may be employed in the surface layer, in place of the compound of the Formula (1). The charge transportable compound containing a group containing silicone atom is represented by the following structure. The compound can form a siloxane based resin layer containing charge transportable structural unit.

$$B—(—Z—Si(R_{11})_{3-a}(R_{12})_a)_n$$

In the formula, B is a group containing structural unit having charge transportability, $R_{11}$ is a hydrogen atom, an alkylene or arylene group which may have a substituent, $R_{12}$ is a hydrolyzable group or hydroxy group, Z is an alkylene or arylene group which may have a substituent, and n is an integer.

The most preferable layer configuration of the present invention is described above. However, in the present invention, the layer configuration, which is different from that described above, may be employed. For example, when a resin layer, which comprises the siloxane based resin, having structural units possessing charge transportability, is applied to a charge transport layer, the surface layer in the layer configuration of a photoreceptor may be eliminated. Further, when a resin layer, which comprises the siloxane based resin having structural units possessing charge transportability, is applied to the photosensitive layer having a single layer configuration, it is possible to form on a cylindrical electrically conductive support the electrophotographic photoreceptor of the present invention, employing two resin layers consisting of a sublayer and a photosensitive layer having a single layer configuration.

Further, the surface layer of the electrophotographic photoreceptor of the present invention preferably exhibits a contact angle between the surface of the photoreceptor and water of at least 90 degrees. By allowing said surface to exhibit a contact angle between the surface of the photoreceptor and water of at least 90 degrees, it is possible to further decrease filming of paper dust as well as of fine toner powder.

As a method to allow said siloxane based resin layer, possessing charge transportability, to exhibit a contact angle between the surface of the photoreceptor and water of at least 90 degrees, it is effective to increase the hydrophobicity of said siloxane resin layer. In order to achieve the foregoing, listed are methods in which F atom containing groups are introduced into said siloxane resin, a dimethyl siloxane skeleton is introduced, aromatic groups are introduced, and resinous particles or organic polymers such as PTFE having water resistance are added. organic particles or inorganic particles can be employed in the resin layer of the invention, in place of or in combination with, the colloidal silica mentioned above are described below.

Organic Fine Particles

Examples of the organic fine particles include resin fine particles of polytetrafluoroethylene, polychlorotrifluoroethylene, polyfluoridevinylidene, polyfluoroethylene, polydichlorodifluoroethylene, tetrafluoroethylene-perfluoroalkylvinylether copolymer, tetrafluoroethylene-hexafluoropropylene copolymer, tetrafluoroethylene-ethylene copolymer, tetrafluoroethylene-hexafluoropropylene-perfluoroalkylvinylether copolymer, silicone resin, polyethylene, polypropylene and melamine. The organic fine particles have average volume diameter of 0.05 to 10 μm, preferably 0.1 to 5 μm. They are added in a resin layer of the photoreceptor in an amount of 0.01 to 50 weight %, preferably 1 to 50 weight % with reference to the binder resin of the resin layer. Among those resin fine particles containing fluorine atom are preferable. Cleaning of residual toner becomes easy by incorporating the resin fine particles containing fluorine atom in the resin layer.

Inorganic Fine Particles

Examples of the organic fine particles include a metal oxide such as magnesium oxide, calcium oxide, titanium oxide, zirconium oxide, stannous oxide, aluminum oxide, silicone oxide (silica), indium oxide, beryllium oxide, led oxide, and bismuth oxide, nitride such as boron nitride, aluminum nitride, and silicone nitride, and carbide such as silicone carbide and boron carbide. The inorganic particles may be subjected to hydrophobic treatment with the hydrophobic treatment agent such as a titanium coupling agent, a silane coupling agent, and a aluminum coupling agent.

The organic fine particles have average volume diameter of 0.05 to 10 μm, preferably 0.1 to 5 μm. They are added in a resin layer of the photoreceptor in an amount of 0.01 to 50 weight %, preferably 1 to 50 weight % with reference to the binder resin of the resin layer. Among those resin fine particles containing fluorine atom are preferable. Cleaning of residual toner becomes easy by incorporating the resin fine particles containing fluorine atom in the resin layer.

The volume average volume particle size of the organic fine particles or inorganic fine particles can be measured by the laser diffraction/scattering type particle distribution tester LA-700, product by HORIBA, Ltd.

Further, it is possible to effectively minimize the increase in residual potential as well as image blurring by adding antioxidants to the surface layer of said siloxane based resin.

The antioxidants, as described herein, means materials, as representative ones, which minimize or retard the action of oxygen under conditions of light, heat, discharging, and the like, with respect to auto-oxidation occurring materials which exist in the electrophotographic photoreceptor or the surface thereof. Specifically, a group of such compounds described below is listed.

(1) Radical Chain Inhibitors

Phenol based antioxidants (hindered phenol based) Amine based antioxidants (hindered amine based, diallyldiamine based, diallylamine based) Hydroquinone based antioxidants (hindered phenol based)

(2) Peroxide Decomposing Agents

Sulfur based antioxidants (thioethers)

Phosphoric acid based antioxidants (phosphorous acid esters)

Of said antioxidants, preferred are radical chain inhibitors included in (1). Specifically hindered phenol based or hindered amine base antioxidants are preferable. Further two or more types may be employed in combinations. For example, hindered phenol based antioxidants listed in (1) are preferably employed together with thioether antioxidants listed in (2). Further, antioxidants may be employed in which structural units of said antioxidants such as hindered phenol structural units and hindered amine structural units are incorporated into molecules.

Of said antioxidants, hindered phenol based and hindered amine based antioxidants are specifically effective for minimizing the formation of background stain as well as image blurring under high temperature and high humidity.

The content of hindered phenol based or hindered amine based antioxidants in a resin layer is preferably between 0.01 to 20 percent by weight. When the content is less than 0.01 weight percent, neither background stain nor image blurring is minimized under high temperature and high humidity. On the other hand, when the content is no less than 20 percent by weight, charge transportability on the resin layer is degraded, the residual potential tends to increase, and further, the layer strength decreases.

Further, if desired, said antioxidants may be incorporated into a charge generating layer in the lower layer, a charge transport layer, an interlayer, or the like. The added amount of said antioxidants to these layers is preferably between 0.01 and 20 percent by weight with respect to each layer.

The hindered phenols as described herein means compounds having a branched alkyl group in the ortho position relative to the hydroxyl group of a phenol compound and derivatives thereof. (However, the hydroxyl group may be modified to an alkoxy group.)

The hindered amines are compounds having an organic bulky group neighboring to nitrogen atom. An example of the bulky group is branched alkyl group, preferable example of which is t-butyl group. The preferable examples of the compounds having organic group are those represented by the following structural formula:

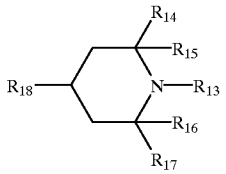

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group.

Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Phosphoric acid compounds include, for example, compounds represented by General Formula RO—P(OR)—OR. Listed as representative compounds are those described below. Incidentally, in said General Formula, R represents a hydrogen atom, and a substituted or unsubstituted group of any of an alkyl group, an alkenyl group or an aryl group.

Organic sulfur compounds include, for example, compounds represented by General Formula R—S—R. Listed as representative compounds are those described below. Incidentally, in the general formula, R represents a hydrogen atom, and a substituted or unsubstituted group of any of an alkyl group, an alkenyl group or an aryl group.

Compound examples of representative antioxidants are listed below.

1-1

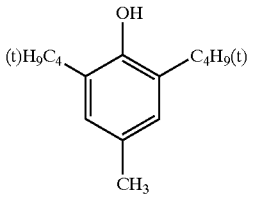

1-2

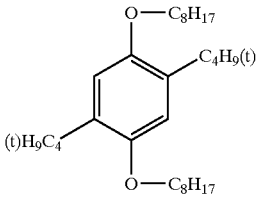

1-3

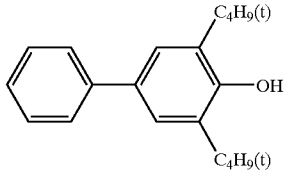

1-4

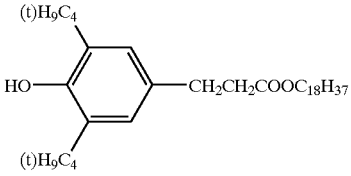

1-5

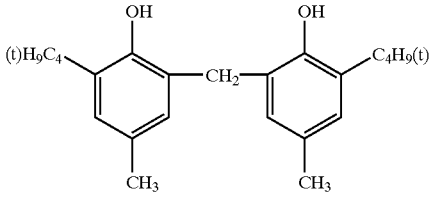

1-6

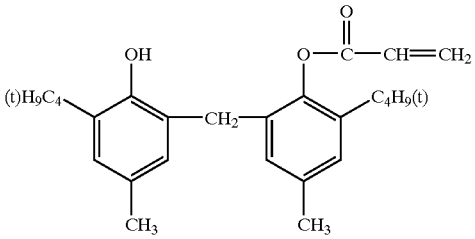

1-7

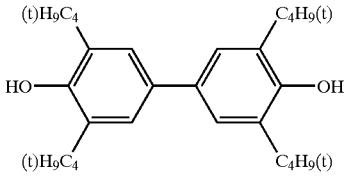

1-8

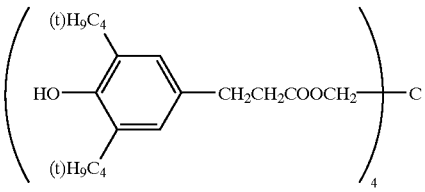

-continued 1-9

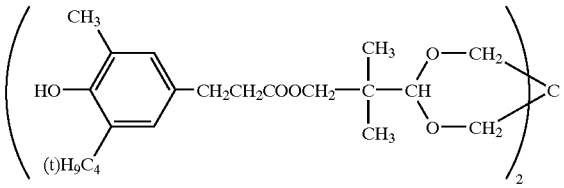

1-10

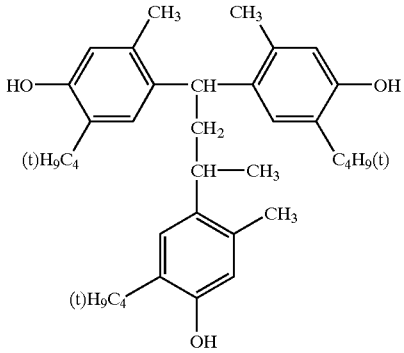

2-8

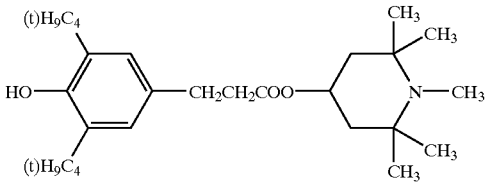

2-9

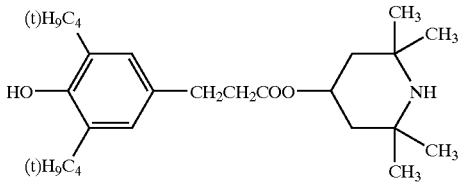

2-10

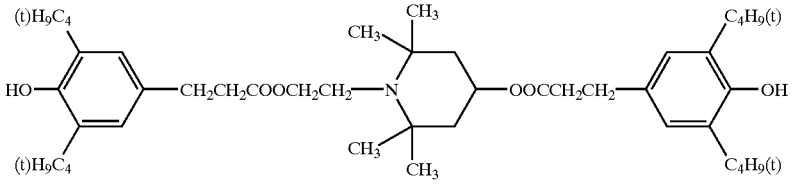

Examples of antioxidant available on the market include the followings.

Hindered phenol type antioxidant: Ilganox 1076, Ilganox 1010, Ilganox 1098, Ilganox 245, Ilganox 1330, Ilganox 3114, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The siloxane based resin containing layer of the present invention is formed by dissolving siloxane based resinous composition in common solvents and coating the resultant composition onto a support. Employed as said solvents are alcohols and derivatives thereof such as methanol, ethanol, propanol, butanol, methyl cellosolve, ethyl cellosolve, and the like; ketones such as methyl ethyl ketone, acetone, and the like; esters such as ethyl acetate, butyl acetate, and the like; and the like.

The siloxane based resin layer of the present invention is preferably dried by heating. Cross linking and hardening reaction in said siloxane based resin layer is enhanced by said heating. Said crosslinking and hardening conditions vary depending on the types of solvents used as well as the presence and absence of catalysts, but heating in the range of about 60 to about 160° C. is preferably carried out over 10 minutes to 5 hours, and heating in the range of 90 to 120° C. is more preferably carried out over 30 minutes to 2 hours.

Solvents, which are employed to disperse or dissolve charge generating materials as well as charge transport materials, include hydrocarbons such as toluene, xylene, and the like; halogenated hydrocarbons such as methylene chloride, 1,2-dichloroethane, and the like; ketones such as methyl ethyl ketone, cyclohexanone, and the like; esters such as ethyl acetate, butyl acetate, and the like; alcohols and derivatives thereof such as methanol, ethanol, methyl cellosolve, ethyl cellosolve, and the like; ethers such as tetrahydrofuran, 1,4-dioxane, 1,3-dioxolane, and the like; amines such as pyridine, diethylamine, and the like; amides such as N,N-dimethylformamide, and the like; fatty acids and phenols; sulfur and phosphorous compounds such as carbon disulfide, trimethyl phosphate, and the like; and the like. These may be employed individually or in combination.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

The means employed in the image forming apparatus used for the image forming method of the invention will be described referring to examples. The apparatus does not necessitates all of the means described below, and t is composed of optionally some of the means.

Precharging Exposure Process (Exposure to Eliminate the Residual Charge on the Photoreceptor Just Prior to Image Formation)

In the precharging exposure process, light irradiation is carried out employing LED, and the like. The precharging exposure retards an increase in the residual potential due to delayed response of the photoreceptor, as well as retards the memory generation due to the exposure pattern. However, the electrophotographic photoreceptor of the present invention is capable of producing consistent images over an extended period of time, in the system having no precharging exposure.

Charging Process

Either a corona charging system, or a roller charging system or magnetic brush charging system may be employed.

Image Exposure Process

Suitably employed as exposure light sources may be any of white light, LED, and LD. In the case of digital images, LED, as well as LD, is preferably employed as the image exposure light source.

Development Process

Either single component or double component developer material can be employed for the development process, while either magnetic or non-magnetic toner may be suitably employed. Both of contacting development in which the photoreceptor contacts with the developer or non-contact development may be employed.

Transfer Process

Any transfer system employing a corona transfer, a roller transfer, and an intermediate transfer material is suitably employed in the transfer process.

Cleaning Process

Common cleaning blades are suitably employed. Further, employed as auxiliary members for cleaning may be fur brushes and rollers. Since cleaning conditions largely affect the wear of a photoreceptor, use of the electrophotographic photoreceptor of the present invention allows for widely adaptable cleaning processes.

The cleaning means which is significantly related to the decrease of thickness of the photoreceptor and filming, is described.

Properties of the Cleaning Blade and Contact Conditions

The cleaning means employed in the present invention is one which is provided with a blade-shaped cleaning member which is arranged to be in pressure contract with the photoreceptor. By employing said cleaning blade, the residual toner on the photoreceptor, which has not been transferred, is removed. From the viewpoint of improvement of cleaning properties, said cleaning blade is preferably brought into contact with the photoreceptor under conditions of a pressure contact force of 5 to 50 g/cm in terms of linear pressure. When said pressure contact force is less than 5 g/cm, the toner tends not to be completely removed, while when said pressure contact force is not less than 50 g/cm, blade curl tends to result.

Incidentally, during a pre-stage of the cleaning process, in order to facilitate cleaning, a charge eliminating process, which eliminates charges on the photoreceptor surface, is preferably added. Said charge eliminating process is carried out employing, for example, a charge eliminator which results in alternative current corona discharge.

The cleaning blade employed in the present invention is preferably comprised of elastic rubber materials having a hardness of 65° to 75° and an impact resilience of 15 to 60 percent (at 20° C. and 50±5 percent RH). When the impact resilience is less than 15 percent, the bounding of said blade tends to occur and at an ambience of relatively low temperature, it is difficult to maintain desired cleaning properties. On the other hand, when the impact resilience exceeds 75 percent, said blade tends to increase in the following properties and blade curl tends to occur (physical property parameters, hardness and impact resilience, of the elastic body rubber blade employed in said cleaning blade are measured employing JIS K6301 Vulcanized Rubber Physical Test Method.).

The cleaning blade employed in the present invention may be made of silicone rubber, urethane rubber, and the like, but a blade made of urethane rubber is most preferable.

The embodiments of the image forming method and image forming apparatus are described.

Figure 3:
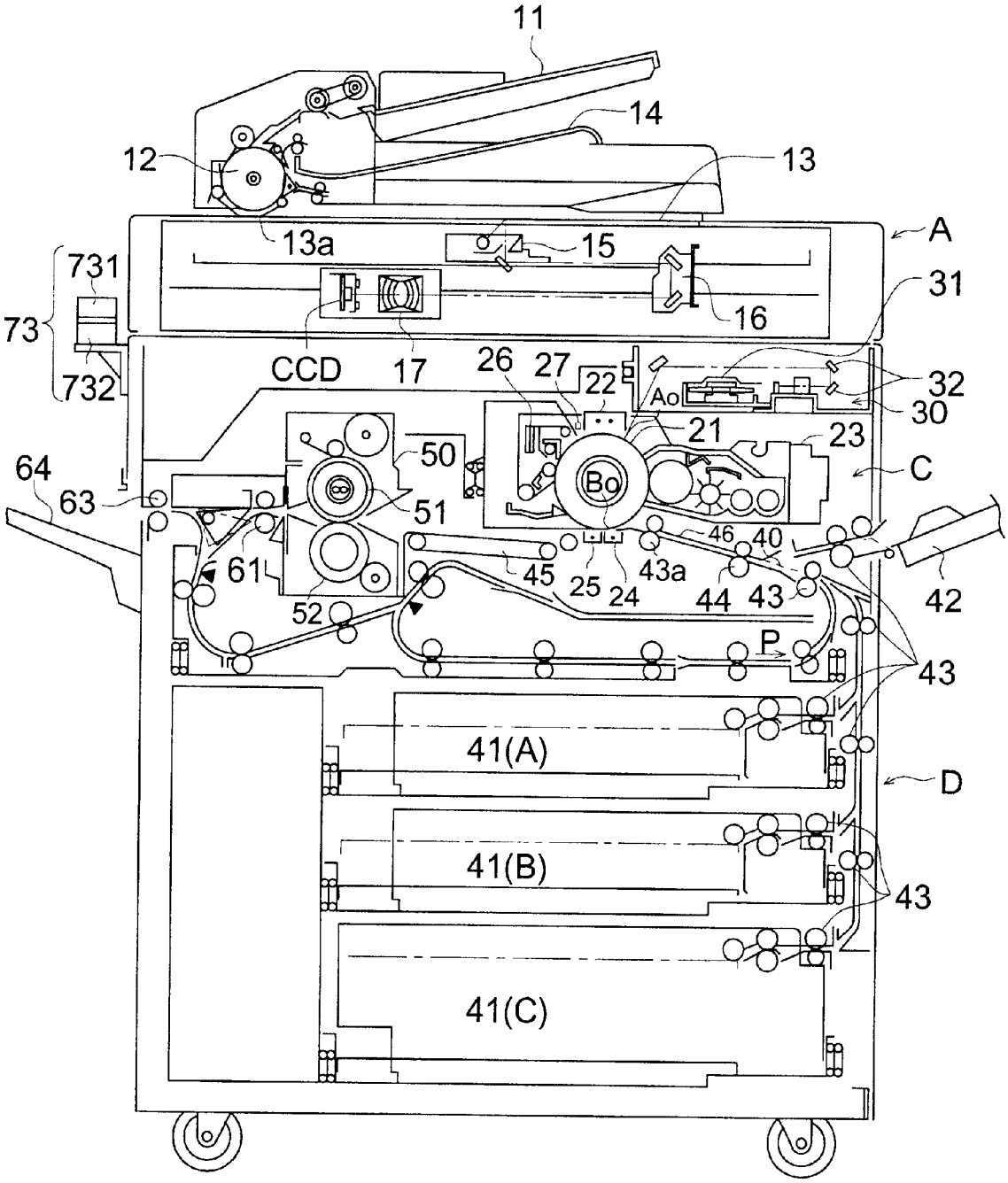
FIG. 3 is a view showing the entire constitution of the image forming apparatus of the present invention.

FIG. 3 is a cross-sectional view of an electrophotographic image forming apparatus as one example of the image forming apparatus of the present invention.

The image forming apparatus shown in FIG. 3 is one employing a digital system, and is comprised of image reading section A, image processing section B (not shown), image forming section C, and transfer paper conveying section D as the transfer paper conveying means.

In the upper part of image reading section A, provided is an automatic document conveying means which automatically conveys the original documents. Original documents, which are placed on document platen 11, are conveyed sheet by sheet and conveyed by original document conveying roller 12, and image reading is carried out at reading position 13*a*. The original document, which has been read, is ejected onto document ejecting tray 14, utilizing document conveying roller 12.

On the other hand, the image of the original document, which is placed on platen glass 13, is read by reading operation at a speed of v of first mirror unit 15 comprised of an illuminating lamp and a first mirror which constitutes an optical scanning system and by movement at a speed of v/2 in the same direction of second mirror unit 16 comprised of a second mirror and a third mirror which are positioned in a V letter.

The read image is focused through projection lens 17 onto the receptor surface of imaging sensor CCD of a line sensor. The linear optical image, which has been focused onto the imaging sensor CCD, is successively subjected to photoelectric conversion to obtain electric signals (brightness signals), and thereafter, is subjected to A/D conversion. The resultant signals are then subjected to various processes such as density conversion, a filtering process, and the like in image processing section B, and then the resultant image data are temporarily stored in a memory.

In image forming section C, arranged as image forming units are drum-shaped image bearing photoreceptor (hereinafter referred to as a photoreceptor drum) 21, and around said photoreceptor drum, charging unit 22 as the charging means, development unit 23 as the development means, transfer unit 24 as the transfer means, separating unit 25 as the separating means, cleaning unit 26 and PCL (pre-charge lamp) 27 in said order for each cycle. Photoreceptor 21 is prepared by applying photoconductive compounds onto a drum base body. For example, organic photoconductors (OPC) are preferably employed. Said drum rotates clockwise as shown in FIG. 3.

After rotating the photoreceptor is uniformly charged employing charging unit 22, image exposure is carried out based on image signals retrieved from the memory of image processing section B, employing exposure optical system 30. In said exposure optical system 30 which is utilized as the writing means, a laser diode (not shown) is employed as the light emitting source, and primary scanning is carried out in such a manner that light passes through rotating polygonal mirror 31, an fθ lens (having no reference numeral), and a cylindrical lens (also having no reference numeral), and the light path is deflected by reflection mirror 32. As a result, image exposure is carried out at position $A_0$ with respect to photoreceptor 21, and a latent image is formed by the rotation (secondary scanning) of photoreceptor 21. In one example of the present embodiment, exposure is carried out for a text section and the latent image is formed.

The latent image on photoreceptor 21 is subjected to reversal development employing development unit 23, and a visualized toner image is formed on the surface of said photoreceptor 21. In transfer sheet conveying section D, under the image forming unit provided are sheet supply units 42(A), 41(B), and 41(C) as paper sheet storing means, in which different-sized paper sheets P are stored, and provided on the exterior, is manual paper sheet supply unit 42 by which paper sheets are manually supplied. Paper sheet P, which is selected from any of these paper sheet supply units is conveyed along conveying path 40 employing paired guide rollers 43, and the conveyance of the paper sheet P is temporarily suspended by paired register rollers 44 which correct the inclination as well as the deviation of the paper sheet P, and thereafter the conveyance resumes again. Paper sheet P is guided by conveyance path 40, paired pre-transfer rollers 43*a*, and guide plate 46 so that the toner image on photoreceptor 21 is transferred onto paper sheet P at transfer position $B_0$ employing transfer unit 24. Subsequently, charge elimination is carried out employing separation unit 25; paper sheet P is separated from the surface of the photoreceptor 21 and is conveyed to fixing unit 50, employing conveying unit 45.

Fixing unit 50 comprises fixing roller 51 as well as pressure roller 52. By passing paper sheet P between fixing roller 51 and pressure roller 52, heat as well as pressure is applied to melt-fix the toner. Paper sheet P, which has been subjected to fixing of its toner image, is ejected onto paper sheet ejecting tray 64.

A cleaning method using a cleaning blade is preferably employed for the cleaning process in the invention.

Properties of the Cleaning Blade and Contact Conditions

The cleaning means employed in the present invention is one which is provided with a blade-shaped cleaning member which is arranged to be in pressure contract with the photoreceptor. By employing said cleaning blade, the residual toner on the photoreceptor, which has not been transferred, is removed. From the viewpoint of improvement of cleaning properties, said cleaning blade is preferably brought into contact with the photoreceptor under conditions of a pressure contact force of 5 to 50 g/cm in terms of linear pressure. When said pressure contact force is less than 5 g/cm, the toner tends not to be completely removed, while when said pressure contact force is not less than 50 g/cm, blade curl tends to result.

When said pressure contact force P' is less than 5 g/cm, the toner tends not to be completely removed, while when said pressure contact force P' is no less than 50 g/cm, blade curl tends to result. Pressure contact methods include a method in which a pressure contact position is previously determined and the blade is then stationarily fixed, a method in which load is adjusted employing a weight, a method employing a spring, and the like. Of these, in order to minimize the fluctuation of the pressure contact force, the weight load method is preferred.

Incidentally, during a pre-stage of the cleaning process, in order to facilitate cleaning, a charge eliminating process, which eliminates charges on the photoreceptor surface, is preferably added. Said charge eliminating process is carried out employing, for example, a charge eliminator which results in alternative current corona discharge.

The embodiments of the present invention will now be specifically described. Incidentally, "parts" described below is "parts by weight".

Photoreceptors were prepared as described below (in each Example, photoreceptors for testing a decrease in layer thickness and for evaluating images were prepared).

Preparation of Photoreceptor 1

The interlayer coating composition described below was prepared and applied onto a washed 60 mmϕ cylindrical aluminum base body, employing a dip coating method, resulting in an interlayer having a dried layer thickness of 0.3 μm.

| <Coating Composition of Interlayer (UCL)> | |
|---|---|
| Polyamide resin (Amilan CM-8000, produced by Toray Co.) | 60 g |
| Methanol | 1600 ml |

The coating composition described below was mixed and dispersed for 10 hours employing a sand mill, resulting in a charge generating layer coating composition. The resulting coating composition was applied onto said interlayer to form a charge generating layer having a dried layer thickness of 0.2 μm.

| <Charge Generating Layer (CGL) Coating Composition> | |
|---|---|
| Y type titanyl phthalocyanine (the maximum peak angle of X-ray diffraction utilizing Cu-α characteristic X-ray is 27.3 degrees in terms of 2θ) | 60 g |
| Silicone resin solution (KR5340, 1.5 percent xylene-butanol solution, produced by Shin-Etsu Kagaku Co.) | 700 g |
| 2-Butanone | 2000 ml |

The coating composition described below was mixed and dissolved whereby a charge transport layer was prepared. The resulting coating composition was applied onto said charge generating layer, employing a dip coating method, resulting in a 20 μm thick charge transport layer.

| <Charge Transport Layer (CTL) Coating Composition> | |
|---|---|
| Charger transport material (4-methoxy-4'-(4-methyl-α-phenylstyryl)triphenylamine | 200 g |
| Bisphenol Z type polycarbonate (Ubiron 300, manufactured by Mitsubishi Gas Kagaku Co.) | 300 g |
| 1,2-Dichloroethane | 2000 ml |

The coating composition described below was mixed and dissolved to prepare an overcoat layer coating composition.

Overcoat layer (OCL) Coating Composition

Added to 10 weight parts of polysiloxane resin which had been formed employing 80 mole percent of methylsiloxane units and 20 mole percent of methyl-phenylsiloxane units was Molecular Sieve 4A (Wako Junyaku). Subsequently the resulting mixture was set aside for 15 hours and was then subjected to dehydration. The resulting resin was dissolved in 10 weight parts of toluene, and 5 weight parts of methyltrimethoxysilane and 0.2 weight part of dibutyl tin acetate were added and dissolved in the resulting solution. Subsequently 6 weight parts of dihydroxymethyltriphenylamine (Exemplified Compound B-1) and 0.3 weight part of hindered amine (Exemplified Compound 2-1) were added to the resulting solution and mixed. The resulting solution was coated as an overcoat layer having a dried layer thickness of 2 μm, and was subjected to thermal hardening at 120° C. for one hour, whereby Photoreceptor 1 was prepared.

Preparation of Photoreceptor 2

Photoreceptor 2 was prepared in the same manner as Photoreceptor 1, except that the interlayer of Example 1 was replaced with the interlayer described below.

| <Interlayer (UCL) Coating Composition> | |
|---|---|
| Zirconium chelate compound ZC-540 (Matsumoto Seiyaku Co., Ltd.) | 200 g |
| Silane coupling agent KMB-903 (Shin-Etsu Kagaku Co., Ltd.) | 100 g |
| Methanol | 700 ml |
| Ethanol | 300 ml |

A composition comprised of said materials was subjected to dip coating, and the resulting coating was dried at 150° C. for 30 minutes to form an interlayer having a dried layer thickness of 1.0 mm.

Preparation of Photoreceptor 3

The dispersion described below was prepared and applied onto a 60 mmϕ cylindrical drawn aluminum base body and subsequently dried. Thus an electrically conductive layer having a dried layer thickness of 15μ was formed.

| <Coating Composition of Electrically Conductive Layer (ECL)> | |
|---|---|
| Phenol resin | 160 g |
| Electrically conductive titanium oxide | 200 g |
| Methyl cellosolve | 100 ml |

The interlayer coating composition described below was prepared. The resulting coating composition was applied onto said electrically conductive layer whereby an interlayer, having a dried layer thickness of 0.2 μm, was formed.

| <Coating Composition of Interlayer (UCL)> | |
|---|---|
| Polyamide resin (Amilan CM-8000, produced by Toray Inc.) | 60 g |
| Methanol | 1600 ml |
| 1-Butanol | 400 ml |

Materials described below were mixed and dispersed for 10 hours, employing a sand mill, whereby a charge generating layer coating composition was prepared. The resulting coating composition was applied onto said interlayer employing a dip coating method, whereby a charge generating layer having a dried layer thickness of 0.2 μm was formed.

| <Chagre Generating Layer (CGL) Coating Composition> | |
|---|---|
| Y type titanyl phthalocyanine | 60 g |
| Silicone resin solution (KR5240, 1.5 percent xylene-butanol solution, manufactured by Shin-Etsu Kagaku Co.) | 700 g |
| 2-Butanone | 2000 ml |

Materials described below were mixed and dissolved to prepare a charge transport layer coating composition. The resulting coating composition was applied onto said charge generating layer, employing a dip coating method, to form a charge transport layer having a dried layer thickness of 20 μm.

| <Charge Transport Layer (CTL) Coating Composition> | |
|---|---|
| Charge transport material (4-methoxy-4'-(4-methyl-α-phenylstyryl)triphenylamine) | 200 g |
| Bisphenol Z type polycarbonate (Ubiron Z300, manufactured by Mitsubishi Gas Kagaku Co.) | 300 g |
| 1.2-Dichloroethane | 2000 ml |

Overcoat layer (OCL) Coating Composition

Added to 10 weight parts of polysiloxane resin which had been prepared employing 80 mole percent of methylsiloxane units and 20 mole percent of methyl-phenylsiloxane units was Molecular Sieve 4A. Subsequently, the resulting mixture was set aside for 15 hours and subjected to dehydration. The resulting resin was dissolved in 10 weight parts of toluene, and subsequently, 5 weight parts of methyltrimethoxysilane, and 0.2 weight part of dibutyl tin acetate were added and dissolved in the resulting solution.

Subsequently, 6 weight parts of dihydroxymethyltriphenylamine (Exemplified Compound B-1) and 0.3 weight part of hindered phenol (Exemplified Compound 1-3) were added to the resulting solution and mixed. The resulting solution was coated onto said CTL as the overcoat layer having a dried layer thickness of 2 μm, and was subjected to thermal hardening at 120° C. for one hour, resulting in Photoreceptor 3.

Preparation of Photoreceptor 4

Added to a mixture solution consisting of 10 weight parts of methylpolysiloxnae, having of a silanol group in an amount of 1 percent by weight, which had been prepared employing 80 mole percent of methylsiloxane units and 20 mole percent of dimethylsiloxane units, and 10 weight parts of toluene was Molecular Sieve 4A. Subsequently, the resulting mixture was set aside for 15 hours and subjected to dehydration. Subsequently, 5 weight parts of methyltrimethoxysilane, and 0.2 weight part of dibutyl tin acetate were added to the resulting solution and dissolved. Added to 100 weight parts of the resulting composition were 200 weight parts of toluene, 40 weight parts of 4-[N,N-bis(3,4-dimethylphenyl)amino]-[2-(triethoxysilyl)ethyl] benzene, and 0.3 weight part of hindered amine (Exemplified Compound 2–10) and mixed. The resulting solution was applied onto the photoreceptor onto which CTL had been applied in the course of the preparation of Photoreceptor 1, and was subjected thermal hardening at 140° C. for 4 hours, whereby Photoreceptor 4 was prepared.

Preparation of Photoreceptor 5

Photoreceptor 5 was prepared in the same manner as Photoreceptor 1, except that the aluminum base body was replaced with a sealed alumite base body, and dihydroxymethyltriphenylamine (Exemplified Compound B-1) was replaced with hydrazone type Exemplified Compound B-14.

Preparation of Photoreceptor 6

Photoreceptor 6 was prepared in the same manner as Photoreceptor 1, except that 5 weight parts of colloidal silica were added to the overcoat layer.

Preparation of Photoreceptor 7

A charge generating layer and its previous layers were applied in the same manner as Photoreceptor 1.

| <Chagre Transport Layer (CTL)> | |
|---|---|
| Charge transport material (Exemplified Compound B-1) | 200 g |
| Methyltrimethoxysilane | 300 g |
| Hindered phenol compound (Exemplified Compound 1–7) | 1 g |
| Colloidal silica (30 percent methanol dispersion) | 8 g |
| 1-Butanol | 50 g |
| 1 percent acetic acid | 50 g |
| Aluminum tetraacetylacetate | 2 g |
| Fluorine resin particles (having an average particle diameter of 1 μm) | 10 g |

Said components were mixed to prepare a charge transport layer coating composition. The resulting coating composition was applied onto said charge generating layer, employing a dip coating method and subjected to thermal hardening at 110° C. for 2 hours to form a charge transport layer having a dried layer thickness of 12 μm. Thus Photoreceptor 7 was prepared.

Preparation of Photoreceptor 8

A charge transport layer and its previous layers were formed in the same manner as Photoreceptor 1. Subsequently, the components described below were mixed to prepare an overcoat layer coating composition.

| <Overcoat Layer (OCL) Coating composition> | |
|---|---|
| Charge transport material (Exemplified Compound B-1) | 200 g |
| Methyltrimethoxysilane | 300 g |
| Hindered phenol compound (Exemplified Compound 1–8) | 1 g |
| Colloidal silica (30 percent methanol solution) | 8 g |
| Ethanol/t-butanol (weight ratio of 1/1) | 50 g |
| 1 percent acetic acid | 50 g |
| Aluminum tetraacetylacetate | 2 g |
| Silicone oil KF-54 (methyl phenyl silicone oil, Shin-Etsu Kagaku Co., Ltd.) | 1 g |

The above components were mixed and the resulting mixture was applied onto said charge transport layer as the overcoat layer, having a dried layer thickness of 2 μm, and was subjected to thermal hardening at 110° C. for one hour, whereby Photoreceptor 8 was prepared.

Preparation of Photoreceptor 9

Photoreceptor 9 was prepared in the same manner as Photoreceptor 8, except that methyltrimethoxysilane in the overcoat layer was replaced with the mixture of methyltrimethoxysilane and dimethylmethoxysilane (having a weight ratio of 6/4), and silicone oil KF-54 was replaced with X-22-160AS (silicone oil having a hydroxyl group at its terminal, Shin-Etsu Kagaku Co., Ltd.).

Preparation of Photoreceptor 10

During the preparation of Photoreceptor 1, commercially available Primer PC- 7J (produced by Shin-Etsu Kagaku Co.), which had been diluted with toluene by a factor of two, was applied onto the CTL, and subsequently, the resulting coating was dried at 100° C. for 30 minutes to form an adhesive layer having a dried layer thickness of 0.3 μm.

Added to a polysiloxane resin (having a silanol group in an amount of one weight percent), prepared by employing 80 mole percent of methylsiloxane units and 20 mole percent of methylphenylsiloxane units, was Molecular Sieve 4A. Subsequently, the resulting mixture was set aside for 15 hours and then subjected to dehydration. The resulting resin was dissolved in 10 weight parts of toluene. Subsequently, 5 weight parts of methyltrimethoxysilane and 0.2 part of dibutyl tin acetate were added to the resulting solution and dissolved to form a solution.

Subsequently, 6 weight parts of dihydroxymethyltriphenylamine (Exemplified Compound B-1) were added to the resulting solution. Then the resulting solution was applied onto said adhesive layer as the overcoat layer having a dried layer thickness of 1 μm, and subsequently dried at 120° C. for one hour, whereby Photoreceptor 10 was prepared.

Preparation of Photoreceptor 11

Photoreceptor 11 was prepared in the same manner as Photoreceptor 1, except that 6 weight parts of dihydroxymethyltriphenylamine (Exemplified Compound B-1) were removed from the OCL.

Preparation of Photoreceptor 12

Photoreceptor 12 was prepared in the same manner as Photoreceptor 1, except that the OCL was removed.

Preparation of Photoreceptor 13

A CTL and its previous layers were applied in the same manner as Photoreceptor 1.

Synthesis of Binder Resin A of Overcoat Layer

Added to a solution prepared by dissolving 100 parts of a phenoxy resin (PKHJ, manufactured by Union Carbide Co.) in 1,000 parts of tetrahydrofuran were 30 parts of 2,3-dihydropyrane and 1 part of concentrated sulfuric acid, and the resulting mixture underwent reaction at room temperature for 3 hours. After the reaction, reaction products were deposited in a relatively large amount of methanol, washed with methanol, and subsequently dried. Thus 100 parts of Modified Phenoxy Resin A were obtained. The pyrane modifying ratio of the OH group of said Resin A was 30 percent.

| <Overcoat Layer Coating Composition> | |
|---|---|
| Modified Phenoxy Resin A | 133 g |
| Charge transport material (4-methoxy-4'-(4-methyl-α-phenylstyryl-)triphenylamine) | 60 g |
| Diphenylmethane diisocyanates | 16 g |
| Antioxidant (LS2626, produced by Sankyo Co.) | 1 g |
| 1,3-Dioxolan | 1500 ml |

Said coating composition was applied onto said CTL employing a circular amount regulating type coating apparatus so as to obtain a hardened layer thickness of 5 μm. Thereafter, the resulting coating was thermally hardened at 120° C. for one hour. Thus Photoreceptor 13 was prepared.

Preparation of Photoreceptor 14

A CTL and its previous layers were coated in the same manner as Photoreceptor 1.

| <Overcoat Layer Coating Composition> | |
|---|---|
| Bisphenol Z type polycarbonate (TS2050, manufactured by Teijin Kasei Co.) | 100 g |
| Charge transport material (4-methoxy-4'-(4-methyl-α-phenylstyryl)triphenylamine) | 50 g |
| Fine sintered silica particles (SO—C1, manufactured by Admatecs Co.) | 10 g |
| Antioxidant (LS2626, manufactured by Sankyo Co.) | 1 g |
| 1,3-Dioxolan | 1000 ml |

Said coating composition was applied onto said CTL employing a circular amount regulating type coating apparatus so as to obtain a hardened layer thickness of 5 μm. Thereafter, the resulting coating was thermally hardened at 110° C. for one hour. Thus Photoreceptor 14 was prepared.

Preparation of Photoreceptor 13

A CTL and its previous layers were applied in the same manner as Photoreceptor 1.

Synthesis of Binder Resin A of Overcoat Layer

Added to a solution prepared by dissolving 100 parts of a phenoxy resin (PKHJ, manufactured by Union Carbide Co.) in 1,000 parts of tetrahydrofuran were 30 parts of 2,3-dihydropyrane and 1 part of concentrated sulfuric acid, and the resulting mixture underwent reaction at room temperature for 3 hours. After the reaction, reaction products were deposited in a relatively large amount of methanol, washed with methanol, and subsequently dried. Thus 100 parts of Modified Phenoxy Resin A were obtained. The pyrane modifying ratio of the OH group of said Resin A was 30 percent.

| <Overcoat Layer Coating Composition> | |
|---|---|
| Modified Phenoxy Resin A | 133 g |
| Charge transport material (4-methoxy-4'-(4-methyl-α-phenylstyryl)triphenylamine) | 60 g |
| Diphenylmethane diisocyanates | 16 g |
| Antioxidant (LS2626, produced by Sankyo Co.) | 1 g |
| 1,3-Dioxolan | 1500 ml |

Said coating composition was applied onto said CTL employing a circular amount regulating type coating apparatus so as to obtain a hardened layer thickness of 5 μm. Thereafter, the resulting coating was thermally hardened at 120° C. for one hour. Thus Photoreceptor 13 was prepared.

Preparation of Photoreceptor 14

A CTL and its previous layers were coated in the same manner as Photoreceptor 1.

| <Overcoat Layer Coating Composition> | |
|---|---|
| Bisphenol Z type polycarbonate (TS2050, manufactured by Teijin Kasei Co.) | 100 g |
| Charge transport material (4-methoxy-4'-(4-methyl-α-phenylstyryl)triphenylamine) | 50 g |
| Fine sintered silica particles (SO—C1, manufactured by Admatecs Co.) | 10 g |

-continued

| <Overcoat Layer Coating Composition> | |
|---|---|
| Antioxidant (LS2626, manufactured by Sankyo Co.) | 1 g |
| 1,3-Dioxolan | 1000 ml |

Said coating composition was applied onto said CTL employing a circular amount regulating type coating apparatus so as to obtain a hardened layer thickness of 5 μm. Thereafter, the resulting coating was thermally hardened at 110° C. for one hour. Thus Photoreceptor 14 was prepared.

Each of said Photoreceptors 1 through 14 was subjected to 1,000,000 rotations during the test of a decrease in layer thickness. Based on the results, the decrease in thickness per rotation was obtained. Table 1 shows the results.

TABLE 1

| Photoreceptor No. | Decrease in Thickness per Rotation (in × $10^{-5}$ μm) | Photoreceptor No. | Decrease in Thickness per Rotation (in × $10^{-5}$ μm) |
|---|---|---|---|
| 1 | 0.5 or less | 8 | 0.3 or less |
| 2 | 0.5 or less | 9 | 0.5 or less |
| 3 | 0.5 or less | 10 | 0.5 or less |
| 4 | 0.5 or less | 11 | 1.6 |
| 5 | 0.5 or less | 12 | 9.2 |
| 6 | 0.3 or less | 13 | 0.6 or less |
| 7 | 0.3 or less | 14 | 0.5 or less |

Subsequently, toners for the image evaluation of the present invention were prepared as described below.

Preparation of Toners

Preparation of Toner 1

A mixture consisting of 165 g of styrene, 53 g of n-butyl acrylate, 20 g of carbon black, 8 g of methacrylic acid, and 20 g of lower molecular weight polypropylene was dispersed at 30° C. employing a sand grinder. Subsequently, 2.5 g of 2,2'-azobis(2,4-valeronitrile) as the polymerization initiator were added and dissolved in the resulting dispersion whereby a polymerizable monomer composition was prepared. Subsequently, 450 g of an aqueous solution prepared by dissolving 0.1 M sodium phosphate in 710 g of deionized water were added, and in addition, 68 g of 0.1 M calcium chloride were gradually added while stirring at 12,000 rpm, employing a TK homomixer to prepare a suspension. Said polymerizable monomer composition was then added to the resulting suspension and stirred at 10,000 rpm, employing a TK homomixer for 20 minutes so that said polymerizable monomer composition was dispersed into the water based medium to obtain an average diameter of about 3 μm of droplets. Thereafter, the resulting dispersion underwent reaction at 75° C. for 10 hours. After cooling, tricalcium phosphate was dissolved and removed by adding hydrochloric acid. Subsequently, filtration, washing, and drying were carried out, whereby spherical particles having a number average particle diameter of 3.3 μm were obtained. Obtained particles were designated as "Particles 1".

"Toner 1" was obtained by adding hydrophobic silica (having a number average primary particle diameter of 12 nm) in an amount of one percent by weight to "Particles 1" obtained by said suspension polymerization.

Preparation of Toners 2 through 5

"Toners 2 through 5", comprised of toner particles shown in Table 1, were obtained in the same manner as said Toner 1, except that during the preparation of said Toner 1, the particle diameter and the variation coefficient of particle size distribution were optionally determined by controlling the shape as well as the variation coefficient through controlling the composition temperature, the stirring rotation frequency, and the heating time, based on the monitoring during the aforementioned polymerization and further based on classification in a liquid medium.

Preparation of Toner 6

Added to 10.0 liters of pure water was 0.90 kg of sodium n-dodecylsulfate, and was dissolved while stirring. Subsequently, while stirring, 1.2 kg of Regal 330 (carbon black produced by Cabot Corp.) were gradually added to the resulting solution, and then the resulting mixture was well stirred for one hour followed by continuous dispersion for 20 hours, employing a sand grinder (a medium type homogenizer).

After the completion of dispersion, the particle diameter of the resulting dispersion was determined employing an electrophoresis light scattering photometer ELS-800 produced by Ohtsuka Denshi Co., resulting in a weight average particle diameter of 122 nm. Further, the solid concentration of said dispersion was determined employing a weight method utilizing a static drying, whereby 16.6 percent by weight was obtained.

This dispersion was designated as "Colorant Dispersion 6".

Added to 0.055 kg of sodium dodecylbenzenesulfonate were 4.0 liters of deionized water, and it was dissolved while stirring at room temperature. The resulting solution was designated as Anionic Surface Active Agent Solution A.

Added to 0.014 kg of polyoxyethylene phenyl ether were 4.0 liters of deionized water, and it was dissolved while stirring at room temperature. The resulting solution was designated as Nonionic Surface Active Agent Solution A.

Added to 223.0 kg of potassium persulfate were 12.0 liters of deionized water, and potassium persulfate was dissolved while stirring at room temperature. The resulting solution was designated as Initiator Solution A.

Charged to a reaction vessel fitted with a thermometer, a cooling pipe, and a nitrogen gas inlet unit were 3.41 kg of WAX emulsion (polypropylene emulsion having a number average molecular weight of 3,000, a number average primary particle diameter of 120 nm, and a solid concentration of 20.9 percent), said Anionic Surface Active Agent Solution A, said Nonionic Surface Active Agent A, and 44.0 liters of deionized water, and the resulting mixture was stirred.

The resulting mixture was heated. When the temperature reached 75° C., Initiator Solution A was added. Thereafter, while maintaining the temperature at 75±1° C., a solution comprised of 12.1 kg of styrene, 2.88 kg of n-butyl acrylate, 1.04 kg of methacrylic acid, and 548 g of t-dodecylmercaptan was added.

Further, the resulting solution was heated to 80±1° C., and stirred for 6 hours maintaining said temperature.

The resulting composition was cooled to no more than 40° C., and stirring was terminated. Then, filtration was carried out employing a pole filter. The obtained product was designated as Latex A1.

Incidentally, resinous particles in Latex A1 exhibited a glass transition temperature of 57° C., a softening point of 121° C., a weight average molecular weight of 12,700, and a weight average particle diameter of 120 nm.

Added to 200.7 g of potassium persulfate were 12.0 liters of deionized water, and potassium persulfate was dissolved while stirring at room temperature. The resulting solution was designated as Initiator Solution B.

Charged to a reaction vessel fitted with a thermometer, a cooling pipe, and a nitrogen gas inlet unit were 3.41 kg of WAX emulsion (polypropylene emulsion having a number average molecular weight of 3,000, a number average primary particle diameter of 120 nm, and a solid concentration of 20.9 percent), said Anionic Surface Active Agent Solution A, and said Nonionic Surface Active Agent A, and the resulting mixture was stirred. Subsequently 44.0 liters of deionized water were added to the solution.

The resulting mixture was heated. When the temperature reached 70° C., Initiator Solution B was added. At the same time, a solution which had been prepared by mixing 11.0 kg of styrene, 4.00 kg of n-butyl acrylate, 1.04 kg of methacrylic acid, and 9.02 g of t-dodecylmercaptan was added.

Thereafter, the resulting solution was maintained at 72±2° C., and stirred for 6 hours maintaining said temperature. Subsequently, the temperature was raised to 80±2° C., and stirring was carried out for 12 hours while maintaining said temperature.

The resulting composition was cooled to no more than 40° C., and stirring was terminated. Then, filtration was carried out employing a pole filter. An obtained product was designated as Latex B1.

Incidentally, resinous particles in Latex B1 exhibited a glass transition temperature of 58° C., a softening point of 132° C., a weight average molecular weight of 245,000, and a weight average particle diameter of 110 nm.

An aqueous solution comprised of 5.35 kg of sodium chloride as a salting-out agent and 20.0 liters of deionized water was designated as Sodium Chloride Solution A.

Charged to a reaction vessel fitted with a thermometer, a cooling pipe, and a nitrogen gas inlet unit were 20.0 kg of Latex A1 prepared as above, 5.2 kg of Latex BE, 0.4 kg of Colorant Dispersion, and 20.0 kg of deionized water, and the resulting mixture was stirred. Subsequently, the resulting mixture was heated to 40° C., and Sodium Chloride Solution G, 6.00 kg of isopropanol, and Nonionic Surface Active Agent Solution A were added in said order. Thereafter, after setting aside the resulting mixture for 10 minutes, it was heated and the temperature was raised to 85° C. during 60 minutes. At a temperature of the mixture of 85±2° C., the mixture was stirred for 6 hours while maintaining said temperature, and was subjected to salting-out/fusion. Thereafter, the resulting composition was cooled to no more than 40° C. and stirring was terminated. Filtration was carried out utilizing a 45 $\mu$m sieve. The resultant filtrate was designated as Coalesced Composition (1).

Subsequently, wet cake-like colored particles were collected from Coalesced Composition (1) through filtration utilizing a glass filter. Thereafter, the obtained colored particles were washed with deionized water.

The wet cake-like colored particles, which had been washed as described above, were removed from said glass filter, and were subjected to tray drying at 40° C. for 100 hours employing an air blast dryer.

Block-shaped colored particles, which had been dried, were crushed employing a Henschel crusher.

The colored particles obtained as above were designated as "Colored Particles 6". The resinous particles, which were components of "Colored Particles 6", exhibited a weight average molecular weight of 55,000, a softening point of 125° C., a glass transition temperature of 57° C., and a number average particle diameter of 3.5 $\mu$m, and those having a shape coefficient in the range of from 1.0 to 1.6, were 72.3 percent by number.

Hydrophobic silica (having a number average primary particle diameter of 12 nm) was added to said "Colored Particles 6" in an amount of one percent by weight, whereby "Toner 6" was obtained.

Preparation of Toners 7 through 10

"Toners 7 through 10", comprised of toner particles shown in Table 1, were obtained in the same manner as said Toner 6, except that monitoring of the aforementioned salting-out/fusion stage as well as the shape controlling process was carried out, and the shape and the variation coefficient of the shape coefficient were controlled by controlling the stirring rotation frequency as well as the heating time, and the particle diameter and the variation coefficient of the particle size distribution were optionally adjusted utilizing classification in a liquid medium.

Preparation of Toner 11

Colored particles having a number average particle diameter of 6.9 μm were obtained by melt-knead-pulverizing 100 parts of styrene acrylic resin, 10 parts of carbon black, and 4 parts of lower molecular weight polypropylene (having a number average molecular weight of 3,000). Said particles were designated as "Colored Particles 11".

Hydrophobic silica (having a number average primary particle diameter of 12 nm) was added to "Colored Particles 11" obtained by said kneading pulverization in an amount of 1 percent by weight.

Preparation of Developers

Developers were prepared which were comprised of toners and carriers described below.

Further, developers having a toner concentration of 6 percent were prepared by blending each of "Toners 1 through 11" with a styrene acrylic resin coated ferrite carrier having a volume average particle diameter of 45 μm, and were employed to evaluate printing. These developers were designated as "Developers 1 through 11" corresponding to said toners.

The characteristics of each of said toners were evaluated. Table 2 shows the measurement results.

TABLE 2

| Toner No. | Toner Preparation Method Example No. | Ratio of Toner Particles without Corners (in %) | Number Variation Coefficient (in %) | Ratio of Shape Coefficient of 1.0 to 1.6 (in %) | Number Average Particle Diameter (in μm) | M ($m_1 + m_2$) (in %) |
|---|---|---|---|---|---|---|
| 1 | 1 | 70 | 24.0 | 77.0 | 3.3 | 73 |
| 2 | 2 | 77 | 24.1 | 81.1 | 5.7 | 80 |
| 3 | 3 | 77 | 23.1 | 88.1 | 6.7 | 82 |
| 4 | 4 | 85 | 20.0 | 77.9 | 7.8 | 88 |
| 5 | 5 | 55 | 26.5 | 67.1 | 5.7 | 78 |
| 6 | 6 | 76 | 22.7 | 72.3 | 3.5 | 79 |
| 7 | 7 | 79 | 21.4 | 87.1 | 5.3 | 84 |
| 8 | 8 | 87 | 20.7 | 79.4 | 6.3 | 86 |
| 9 | 9 | 83 | 22.2 | 78.3 | 7.3 | 77 |
| 10 | 10 | 53 | 26.5 | 66.3 | 5.5 | 79 |
| 11 | 11 | 47 | 27.5 | 63.8 | 6.9 | 67 |

Measurement Method of the Number Average Particle Diameter of Each Toner: Measured Employing a Coulter Multisizer Measurement method of the sum of the number distribution relative frequency of toner particles: the particle diameter data of each toner, which were obtained employing said Coulter Multisizer were transmitted to a computer via an I/O unit, and sum M of relative frequency $m_1$ and $m_2$ was obtained employing said computer.

It is possible to measure the volume average particle diameter of carrier particles employing, as a representative apparatus, a laser diffraction type particle size distribution measurement apparatus, "Helos", (manufactured by Sympatec Co.), fitted with a wet type dispersion unit.

Evaluation

Image Evaluation

The present photoreceptor was installed in a digital copier, Konica 7040 (a copier comprising laser exposure, reversal development, and a blade cleaning process), and 100,000 A4 sheets were continually copied under an atmosphere of high temperature and high humidity: HH (30° C. and 80 percent relative humidity). Thus the image evaluation was performed.

An original image document, which was comprised of equal one quarter of a text image having a pixel ratio of 7 percent, a portrait picture, a solid white image, and a solid black image, was copied onto A4 sheets of neutral paper. At every 1000th copy, the halftone, solid white image, and solid black image were evaluated. Image density was evaluated in such a manner that the density of the solid black image was determined as the absolute reflection density, employing RD-918 produced by Macbeth Co. As the rise of residual potential increases, the image density decreases. Fog was measured in such a manner that the density of the employed sheet of paper was zero, and the density of copied solid white images was determined as the relative reflection density, employing RD-918 produced by Macbeth Co. As a decrease in layer thickness increases, fogging tends to occur due to a decrease in chargeability. Image problems were inspected while observing copied images corresponding to the photoreceptor surface.

Process Conditions for Evaluation

Image evaluation conditions, which were employed to operate said 7040 modified copier, were set as described hereunder.

Charging Condition

Charging unit: Scorotron charging unit, in which the initial charge potential was set at −750 V.

Developing Conditions

DC bias: −500 V

Dsd (distance between the photoreceptor and the development sleeve): 600 μm

Regulation of developer layer: magnetic H-Cut system

Thickness of developer layer: 700 μm

Diameter of development sleeve: 40 mm

Transfer Condition

Transfer electrodes: corona charging system

Cleaning Conditions

Elastic body rubber blade: free length of 9 mm, thickness of 2 mm, hardness of 70 degrees, impact resilience of 35, photoreceptor contact pressure (in linear pressure) of 15 g/cm Evaluation Items a. Image Density A: at least 1.2/good B: at least 1.0 to less than 1.2/commercially viable C: less than 1.0/commercially unviable b. Fogging A: less than 0.001/good B: at least 0.001 to less than 0.003/commercially viable C: at least 0.003/commercially unviable c. Image Smearing (the Evaluation of Image Smearing was Carried Out Employing the Text Images)

A: generation of image smearing on 5 sheets or less of 100,000 sheets/good

B: generation of image smearing on 6 to 10 sheets of 100,000 sheet/commercially viable C: generation of image smearing on at least 11 sheets of 100,000 sheets/commercially unviable d. Reproduction Properties of Fine Line The line width of a line image, corresponding to image signals of a 2-dot line, was measured by a printing evaluation system, "RT2000" (produced by Yaman Co., Ltd.).

A: either line width L1 of the first image or line width L100,000 of the 100,000th image is no more than 200 μm and line width difference |L1−L100,000| is no more than 10 μm/good C: beyond the above limits/commercially unviable e. Evaluation of image problems Black spotting was evaluated as follows. The size and number of black spots were measured employing an image analysis apparatus, "Omunicon 3000 Type" (manufactured by Shimadzu Seisakusho), and evaluation was made based on the number of black spots having a size of at least 0.1 mm per A4 sheet. Relatively large-sized image problems such as streak-like image problems (black streak and white streak) and the like due to filming and insufficient transfer were visually evaluated. Black spots and streak-like image problems were evaluated based on the criteria described below.

Black spots and streak-like image problems (evaluation was made utilizing halftone, solid white images, and solid black images)

A: one or no black spot and no streak-like problem/A4 sheet/good

B: 2 or 3 black spots/A4 sheet and no streak-like problem/commercially viable

C: 4 or more black spots/A4 sheet or at least one streak-like problem/commercially unviable f. Non-uniform Decrease in Thickness (in μm)

The absolute value of the difference in the layer thickness between the center and the position of 3 cm from the end of the photoreceptor drum for black

|the layer thickness at the center of the photoreceptor after 100,000th copying—the layer thickness of the same photoreceptor at a position of 3 cm form the end after. 100,000th copying|=Δd (in μm)

Measurement Method of the Layer Thickness of a Photoreceptor

The layer thickness of a potosensitive layer was determined employing an eddy current layer thickness measurement apparatus, Eddy 560C (manufactured by Helmut Fischer GMBTE Co.).

Table 3 below shows the aforementioned evaluation results.

TABLE 3

| | Photoreceptor No. | Developer No. | Image Density | Fogging | Image Smearing | Fine Line Reproduction Properties | Image Problems | Non-uniform Decrease Δd (in μm) |
|---|---|---|---|---|---|---|---|---|
| Example 1 | 1 | 1 | A | A | A | A | A | <0.5 |
| Example 2 | 2 | 2 | A | A | A | A | A | <0.5 |
| Example 3 | 3 | 3 | A | A | A | A | A | <0.5 |
| Example 4 | 4 | 4 | A | B | A | A | B | <1.0 |
| Example 5 | 5 | 5 | A | A | A | A | A | <0.5 |
| Example 6 | 6 | 6 | A | A | A | A | A | <0.5 |
| Example 7 | 7 | 7 | A | A | A | A | A | <0.5 |
| Example 8 | 8 | 8 | A | A | A | A | A | <0.5 |
| Example 9 | 9 | 9 | A | A | A | A | A | <0.5 |
| Example 10 | 10 | 10 | A | A | A | A | A | <0.5 |
| Example 11 | 13 | 1 | B | A | B | A | B | <1.0 |
| Example 12 | 14 | 1 | B | B | A | A | B | <1.0 |
| Comparative Example 1 | 11 | 3 | B | B | C | C | C | <0.5 |
| Comparative Example 2 | 12 | 8 | B | B | C | A | B | >2 |
| Comparative Example 3 | 1 | 11 | B | B | C | C | C | <0.5 |

Based on Table 3, in copying tests which met requirements for combinations of the photoreceptors and developers of the present invention, the resulting images exhibited excellent image quality in terms of density as well as fogging even in the copying tests at high temperature and high humidity, and image problems such as image smearing, streaks, and spots due to insufficient cleaning were markedly minimized to clearly result in excellent images.

The present invention makes it possible to provide an image forming method as well as an image forming apparatus in which by combining an electrophotographic photoreceptor with a minimized thickness decrease with a toner prepared employing suspension polymerization or a toner prepared by fusing resinous particles in a water based medium, image problems such as image smearing, streaks, and spots are minimized under an atmosphere of high temperature, and high humidity and high quality copied images with high durability are obtained.

Preparation of Photoreceptor 13

A CTL and its previous layers were applied in the same manner as Photoreceptor 1.

Synthesis of Binder Resin A of Overcoat Layer

Added to a solution prepared by dissolving 100 parts of a phenoxy resin (PKHJ, manufactured by Union Carbide Co.) in 1,000 parts of tetrahydrofuran were 30 parts of 2,3-dihydropyrane and 1 part of concentrated sulfuric acid, and the resulting mixture underwent reaction at room temperature for 3 hours. After the reaction, reaction products were deposited in a relatively large amount of methanol, washed with methanol, and subsequently dried. Thus 100 parts of Modified Phenoxy Resin A were obtained. The pyrane modifying ratio of the OH group of said Resin A was 30 percent.

| <Overcoat Layer Coating Composition> | |
|---|---|
| Modified Phenoxy Resin A | 133 g |
| Charge transport material (4-methoxy-4'-(4-methyl-α-phenylstyryl)triphenylamine) | 60 g |
| Diphenylmethane diisocyanates | 16 g |
| Antioxidant (LS2626, produced by Sankyo Co.) | 1 g |
| 1,3-Dioxolan | 1500 ml |

Said coating composition was applied onto said CTL employing a circular amount regulating type coating apparatus so as to obtain a hardened layer thickness of 5 μm. Thereafter, the resulting coating was thermally hardened at 120° C. for one hour. Thus Photoreceptor 13 was prepared.

Preparation of Photoreceptor 14

A CTL and its previous layers were coated in the same manner as Photoreceptor 1.

| <Overcoat Layer Coating Composition> | |
|---|---|
| Bisphenol Z type polycarbonate (TS2050, manufactured by Teijin Kasei Co.) | 100 g |
| Charge transport material (4-methoxy-4'-(4-methyl-α-phenylstyryl)triphenylamine) | 50 g |
| Fine sintered silica particles (SO—C1, manufactured by Admatecs Co.) | 10 g |
| Antioxidant (LS2626, manufactured by Sankyo Co.) | 1 g |
| 1,3-Dioxolan | 1000 ml |

Said coating composition was applied onto said CTL employing a circular amount regulating type coating apparatus so as to obtain a hardened layer thickness of 5 μm. Thereafter, the resulting coating was thermally hardened at 110° C. for one hour. Thus Photoreceptor 14 was prepared.

What is claimed is:

1. An electrophotographic image forming method including electrostatic charging on a photoreceptor, imagewise exposing on the photoreceptor to form a latent image, developing the latent image by a developer containing a toner, transferring the developed toner onto an image forming material, and cleaning residual toner on the photoreceptor, wherein decrease ΔHd (in μm), in layer thickness per rotation in wear test of the organic electrophotographic photoreceptor defined below, is in the range of $0 \leqq \Delta Hd < 1 \times 10^{-5}$, and the toner is one which is obtained by suspension-polymerizing a polymerizable composition consisting of at least a polymerizable monomer and a colorant in a water based medium or one which is obtained by fusing resinous particles in a water based medium, said wear test comprising an electrophotographic photoreceptor connected to a driving section being brought into contact with a cleaning blade having a hardness of 70±1°, an impact resilience of 35±1 percent, a thickness of 2±0.2 mm, and a free length of 9±0.1 mm under conditions of a contact angle of 10±0.5 degrees in the counter direction and a thrust amount of 1.5±0.2 mm and while rotating said electrophotographic photoreceptor employing said driving section so that one rotation is completed within 0.1 to 10 seconds, toner particles having a volume average particle diameter of 8.5±0.5 μm, which was blended with powder having a number average particle diameter of 10 to 40 nm as the external additive, in an amount of 1±0.1 percent by weight with respect to said toner, was subjected to development so as to result in an adhered amount of 0.15±0.05 mg/cm$^2$. After development, said toner particles were removed. When said electrophotographic photoreceptor was subjected to at least 100,000 rotations, the layer thickness variation amount of said photoreceptor was measured and the value obtained by dividing the resultant amount by the number of rotations was designated as the layer thickness decreasing amount per rotation.

2. The image forming method of claim 1 wherein the toner is one which is obtained by suspension-polymerizing a polymerizable composition consisting of at least a polymerizable monomer and a colorant in a water based medium.

3. The image forming method of claim 1 wherein the toner is one which is obtained by fusing resinous particles in a water based medium.

4. The image forming method of claim 1, wherein the organic electrophotographic photoreceptor comprises an overcoat layer comprising a siloxane based resin layer containing a structural unit having charge transferability and a bridge structure.

5. The image forming method claim 4, wherein said siloxane based resin layer is one which is formed by allowing an organic silicon compound having a hydroxyl group or a hydrolyzing group to react with the compound represented by General Formula (1).

$$B—(R_1—ZH)_m$$

wherein B represents a univalent or multivalent group comprising structural units having charge transportability, $R_1$ represents a single bond or divalent alkylene group, Z represents an oxygen atom, a sulfur atom or NH, and m represents an integer of 1 to 4.

6. The image forming method of claim 5, wherein Z in the General Formula (1) is an oxygen atom.

7. The image forming method of claim 1, wherein the siloxane based resin layer contains an antioxidant.

8. The image forming method of claim 7, wherein said antioxidant is a hindered phenol based antioxidant or a hindered amine based antioxidant.

9. The image forming method of claim 4, wherein the siloxane based resin layer contains organic or inorganic fine particles.

10. The image forming method of claim 4, wherein the siloxane based resin layer contains colloidal silica.

11. The image forming method of claim 4, wherein the toner has a number average particle diameter of 3 to 8 μm.

12. The image forming method of claim 4, wherein ratio of toner particles having no corners is at least 50 percent by number, and the number variation coefficient in the number particle size distribution is no more than 27 percent in the toner.

13. The image forming method of claim 1, wherein ratio of toner particles having a shape coefficient of from 1.0 to 1.6 is at least 65 percent by number of toner particles.

14. The image forming method described of claim 1, wherein in a particle number based histogram showing a particle size distribution, in which, when the diameter of toner particles is represented by D (in $\mu$m), natural logarithm of D is taken as the abscissa and said abscissa is divided into a plurality of groups at an interval of 0.23, sum M of relative frequency $m_1$ of toner particles included in the most frequent group, and relative frequency $m_2$ of toner particles included in the second most frequent group, is at least 70 percent.

15. An image forming apparatus comprising an organic electrophotographic photoreceptor, a charging unit, an exposing unit, a development unit, a transfer unit, and cleaning unit, wherein decrease $\Delta Hd$ (in $\mu$m), in layer thickness per rotation in said wear test of said organic electrophotographic photoreceptor, is in the range of $0 \leqq \Delta Hd < 1 \times 10^{-5}$, and a toner used in said development process is one which is obtained by suspension-polymerizing a polymerizable composition consisting of at least a polymerizable monomer and a colorant in a water based medium or one which is obtained by fusing resinous particles in a water based medium.

* * * * *